US008091462B2

(12) United States Patent
Dueck et al.

(10) Patent No.: US 8,091,462 B2
(45) Date of Patent: Jan. 10, 2012

(54) FIREARM ATTACHMENT LOCKING SYSTEM

(75) Inventors: Barry W. Dueck, Sunset Beach, CA (US); Karl Honigmann, Anaheim Hills, CA (US)

(73) Assignee: SureFire, LLC, Fountain Valley, CA (US)

( * ) Notice: Subject to any disclaimer, the term of this patent is extended or adjusted under 35 U.S.C. 154(b) by 182 days.

(21) Appl. No.: 12/482,664

(22) Filed: Jun. 11, 2009

(65) Prior Publication Data

US 2010/0313743 A1 Dec. 16, 2010

(51) Int. Cl.
*F41A 21/00* (2006.01)
*F41A 21/32* (2006.01)

(52) U.S. Cl. ..... 89/14.05; 89/14.2; 89/14.3; 89/14.4; 42/76.01

(58) Field of Classification Search ..... 42/79, 147; 89/14; 285/322
See application file for complete search history.

(56) References Cited

U.S. PATENT DOCUMENTS

| | | | | | |
|---|---|---|---|---|---|
| 615,279 | A | * | 12/1898 | Jones | 285/320 |
| 720,688 | A | * | 2/1903 | Hagedorn | 279/71 |
| 1,394,490 | A | * | 10/1921 | Giles | 89/1.702 |
| 2,124,075 | A | | 7/1938 | Moore | |
| 2,222,334 | A | * | 11/1940 | Brouwer | 403/351 |
| 2,267,252 | A | * | 12/1941 | Pitsch | 285/34 |
| 2,412,409 | A | * | 12/1946 | Martin | 411/238 |
| 2,628,854 | A | * | 2/1953 | Gardner | 403/376 |
| 2,809,560 | A | | 10/1957 | Matson et al. | |
| 2,848,814 | A | * | 8/1958 | Walton | 42/126 |
| 2,859,058 | A | * | 11/1958 | Traugott | 403/20 |
| 3,029,540 | A | * | 4/1962 | Pachmayr | 42/79 |
| 3,123,929 | A | * | 3/1964 | Pachmayr et al. | 42/79 |
| 3,163,953 | A | * | 1/1965 | Bridge, Sr. | 42/79 |
| 3,257,108 | A | * | 6/1966 | Pachmayr et al. | 269/45 |
| 3,259,407 | A | * | 7/1966 | Welt | 403/350 |
| 3,440,924 | A | * | 4/1969 | Sawyer | 89/14.5 |
| 3,698,747 | A | * | 10/1972 | Wing et al. | 285/305 |
| 3,766,822 | A | * | 10/1973 | Sophinos | 89/14.5 |
| 4,134,175 | A | * | 1/1979 | Contoyanis | 16/2.1 |
| 5,155,915 | A | * | 10/1992 | Repa | 42/127 |
| 5,259,690 | A | * | 11/1993 | Legge | 403/385 |
| 5,375,361 | A | * | 12/1994 | Rustick | 42/125 |
| 5,377,438 | A | | 1/1995 | Sheinfeld et al. | |
| 5,513,554 | A | * | 5/1996 | Paulsson | 92/18 |
| 5,559,302 | A | * | 9/1996 | Latka | 89/14.05 |
| 5,685,102 | A | * | 11/1997 | Latka | 42/85 |
| 6,026,728 | A | * | 2/2000 | Guhring et al. | 89/14.5 |
| 6,289,623 | B1 | | 9/2001 | Cohen et al. | |
| 6,948,415 | B2 | * | 9/2005 | Matthews et al. | 89/14.4 |
| 7,321,175 | B2 | * | 1/2008 | Culpi et al. | 310/12.19 |
| 7,594,464 | B2 | * | 9/2009 | Dueck | 89/14.4 |
| 7,661,349 | B1 | * | 2/2010 | Brittingham | 89/14.4 |

(Continued)

FOREIGN PATENT DOCUMENTS

| | | |
|---|---|---|
| DE | 103 05 644 83 | 5/2004 |

(Continued)

*Primary Examiner* — Michael Carone
*Assistant Examiner* — Joshua Freeman
(74) *Attorney, Agent, or Firm* — Haynes and Boone, LLP

(57) ABSTRACT

A locking system for a firearm attachment. The locking system having a rotating lock ring having a lock-and-release lever rotatably mounted thereto. The lock-and-release lever having a lock engagement surface optimally configured to forcefully engage a locking surface when in a locked orientation. The locking ring having a nonconcentric engagement surface that repositions in a radial direction when the locking ring rotates and the nonconcentric engagement surface is configured to engage the muzzle of a firearm for locking the muzzle attachment thereto.

41 Claims, 37 Drawing Sheets

U.S. PATENT DOCUMENTS

| | | | | |
|---|---|---|---|---|
| 7,676,976 | B2 * | 3/2010 | Dueck et al. | 42/90 |
| 7,677,150 | B2 * | 3/2010 | Dater et al. | 89/14.05 |
| 2001/0049996 | A1 * | 12/2001 | Fluhr | 89/14.4 |
| 2003/0019352 | A1 * | 1/2003 | Mika | 89/14.05 |
| 2005/0115394 | A1 | 6/2005 | Matthews et al. | |
| 2006/0060076 | A1 * | 3/2006 | Dueck et al. | 89/14.4 |

FOREIGN PATENT DOCUMENTS

| | | | |
|---|---|---|---|
| EP | 0 928 943 | A2 | 7/1999 |
| EP | 1 742 008 | A1 | 1/2007 |

* cited by examiner

FIREARM ATTACHMENT LOCKING SYSTEM

BACKGROUND OF THE DISCLOSURE

Attachments to the muzzle of a firearm generally must be secured in a consistent and reliable manner for proper operation. Whether the attachments are for live ammunition or blank rounds, the attachment mechanism should be intuitive to the user and provide proper engagement to avoid a loose attachment to the muzzle of a firearm.

Suppressors are attached to firearms for suppressing sound and in some cases flash associated with the expanding combusting gases exiting from the muzzle. In general, it is desirable to have a suppressor that can be attached to the muzzle of a firearm quickly and easily in a repeatable manner so as not to modify the "zero" bullet impact of the firearm.

Other attachment fixtures can be utilized to emulate a suppressor or otherwise be provided for certain applications, such as a blank firing adapter, flash suppressor, compensator or other devices configured to be attached to the muzzle of a firearm. A blank firing adapter in general must allow a certain amount of gas expanding from the fired blank to be redirected to operate the automatic action of the rifle, such as a gas system or a gas piston action. However, with any type of blank firing adapter, consideration must be made in the event that real ammunition is accidentally used. It is desirable to have safety systems in place to provide feedback to the shooter that real ammunition has been fired, and to redirect projectiles in the safest possible direction. Described further herein is a detailed discussion of an attachment system for a firearm attachment.

Therefore, providing a locking system which securely locks a firearm attachment, such as a suppressor, to the muzzle is desired. In one form, such an arrangement between locking surfaces can be provided to allow a lock ring to forcefully engage the muzzle region of the firearm and not "back out" or otherwise loosen or rotate in a counter-locking rotation providing an inconsistent and possibly loose engagement. Various embodiments of attachment systems are disclosed herein by way of example.

DETAILED DESCRIPTION

Figure 1:
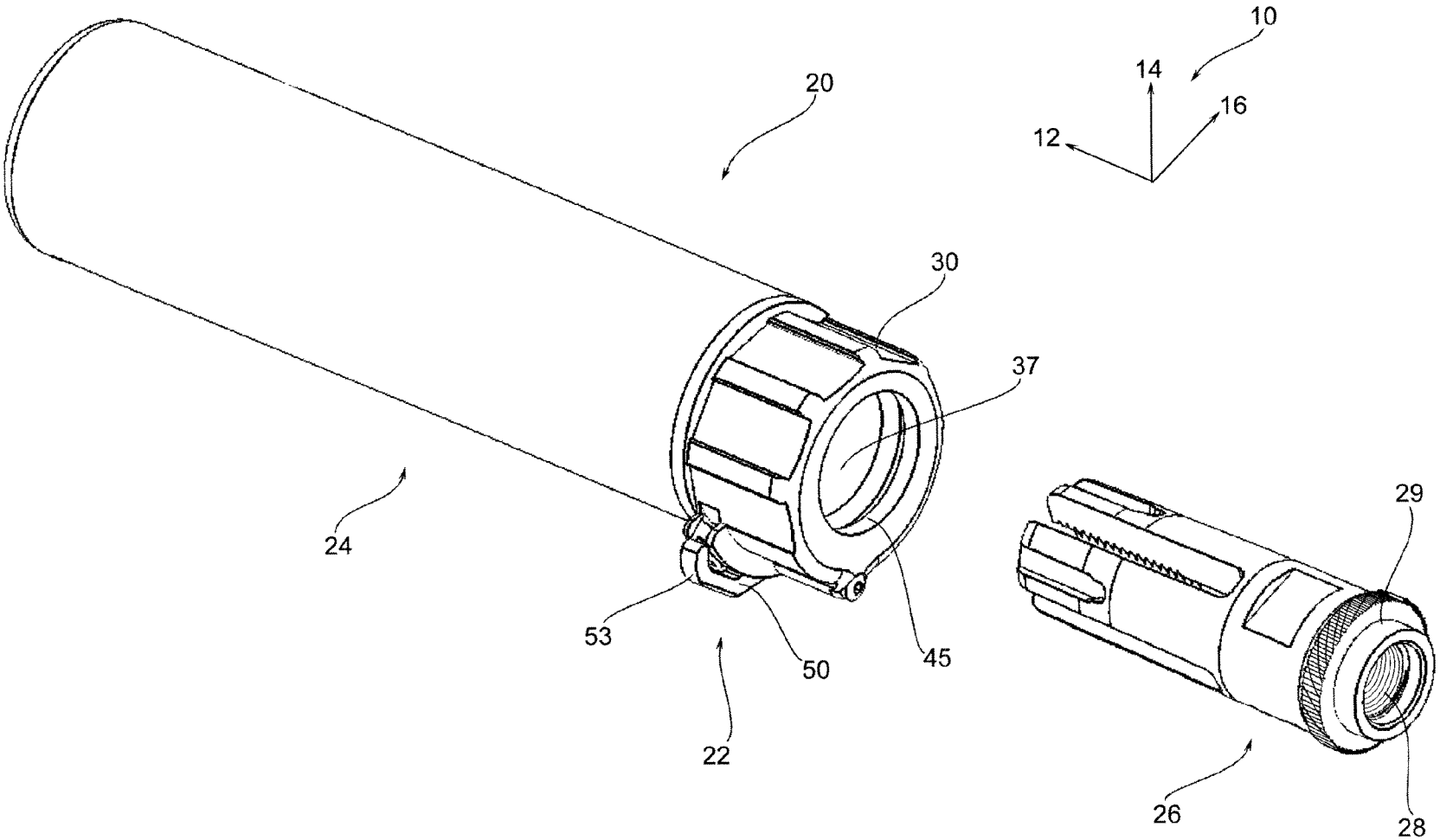
FIG. 1 shows a firearm attachment positioned adjacent to a muzzle of a firearm.

As shown in FIG. 1, there is a firearm attachment 20 such as a suppressor or blank firing adapter which in general comprises a locking assembly 22 and a suppressor body 24. The firearm attachment 20 is operatively configured to be attached to a muzzle 26 of a firearm. FIG. 1 generally shows only a muzzle flash suppressor which is configured to be attached to a barrel by way of the threaded portion 28. An axes system 10 is defined where the axis 12 defines a longitudinal forward direction, the axis 14 defines a vertical direction, and the axes 16 defines a lateral direction pointing to the right-hand lateral direction by reference of the operator of the firearm. It should be further noted that the axes 14 and 16 both generally indicate a radial direction with reference to the centerline of the suppressor body 24. Further, a tangential direction is defined as a general direction perpendicular the radial direction.

Figure 2:
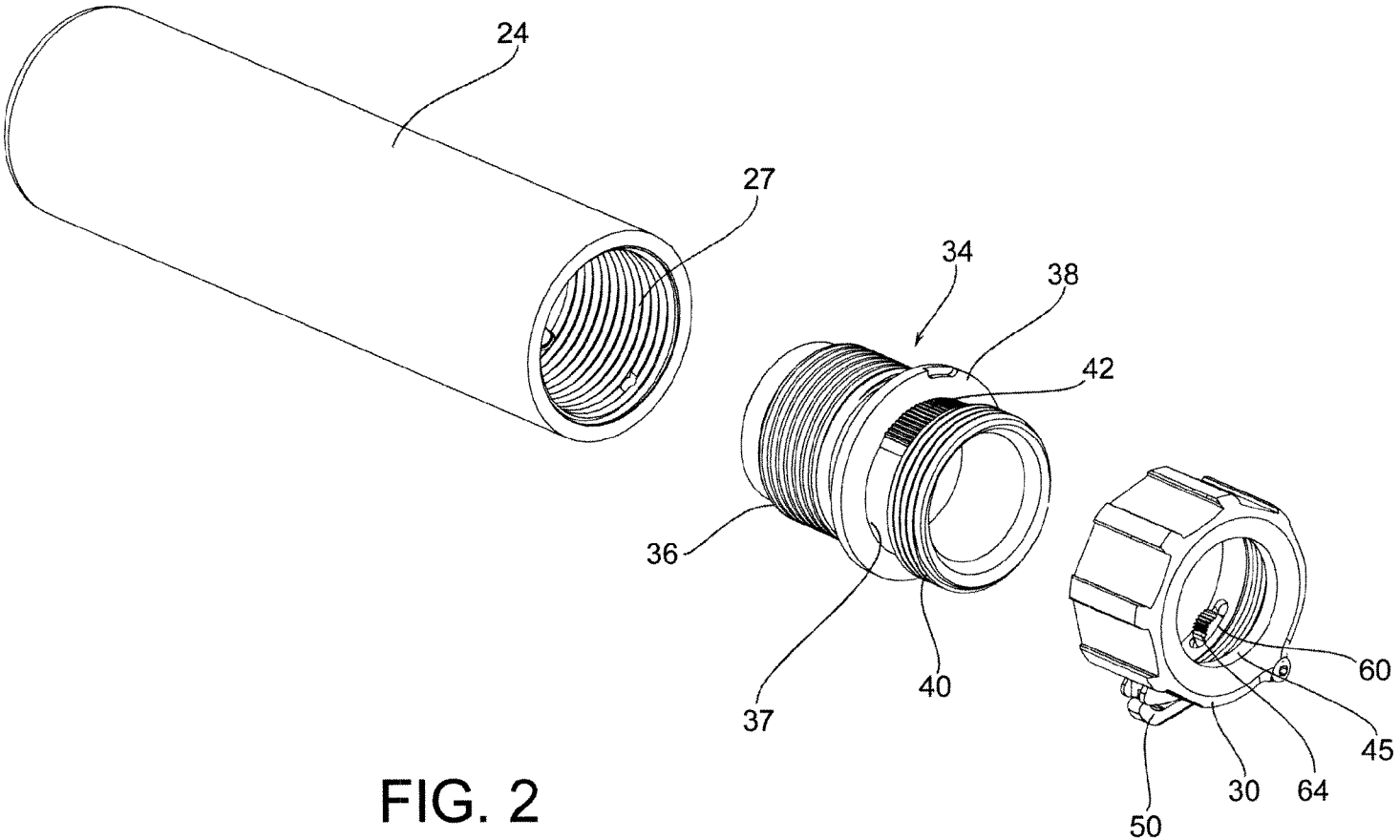
FIG. 2 shows a partially exploded view of one form of a firearm attachment.
Figure 19:
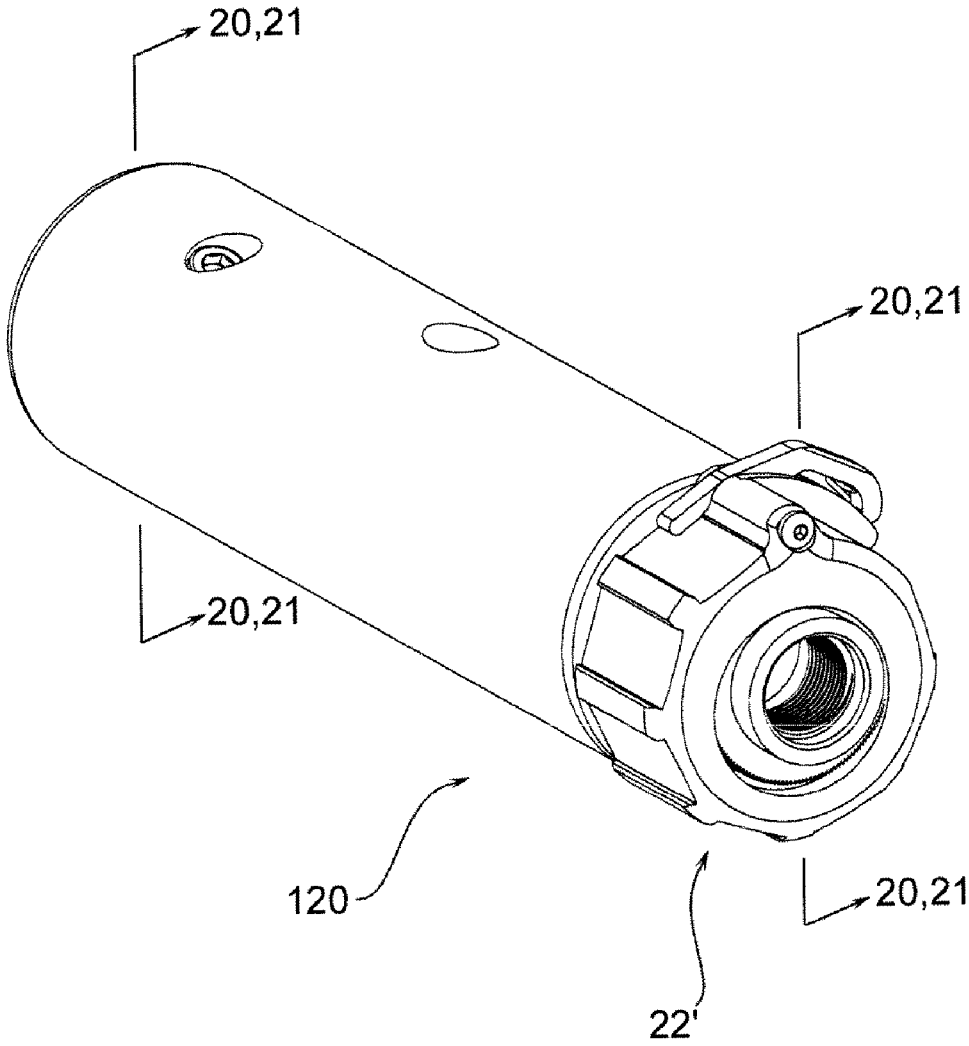
FIG. 19 shows a firearm attachment which in this form is a blank firing adapter.

In general, the locking assembly 22 can be utilized in a variety of forms to lock a suppressor body 24 to a firearm or lock an attachment such as a blank firing adapter 120, as described further herein in FIG. 19. In one form, the locking assembly 22 comprises a lock ring 30 that is operatively configured to rotate with respect to the base mount 34, which is best shown in FIG. 2 in a partially exploded view. In general, the base mount 34 is provided with a body attachment region 36 which in one form is a threaded cylindrical member configured to attach to the base attachment 27 of the suppressor body 24 (see FIG. 2). The base mount 34 further comprises a lock ring attachment region 40 which again in one form is operatively configured to be threadedly attached to the lock ring 30. A base flange 38 is provided on the base mount 34 and is interposed between the body attachment region 36 and the lock ring attachment region 40. Positioned adjacent to the base flange 38 is a locking surface 42 which in one form has a plurality of substantially longitudinal extending indentations operatively configured to engage the lock extension 62 of the lock-and-release lever 50 described further herein (see FIG. 4). In general, the locking surface 42 can be formed of a plurality of types of mechanical locking and frictional engagement-type locking surfaces as well as smooth surfaces. The various geometries with respect to the lock extension 62 engaging the locking surface 42 in conjunction with the rotation of the lock ring 30 will be described herein in detail. In general, in one form, the longitudinally extending ridge of the lock engagement surface 64 of FIG. 4 can either be used directly upon a base mount 34 or upon a muzzle portion or directly upon a firearm.

Figure 3:
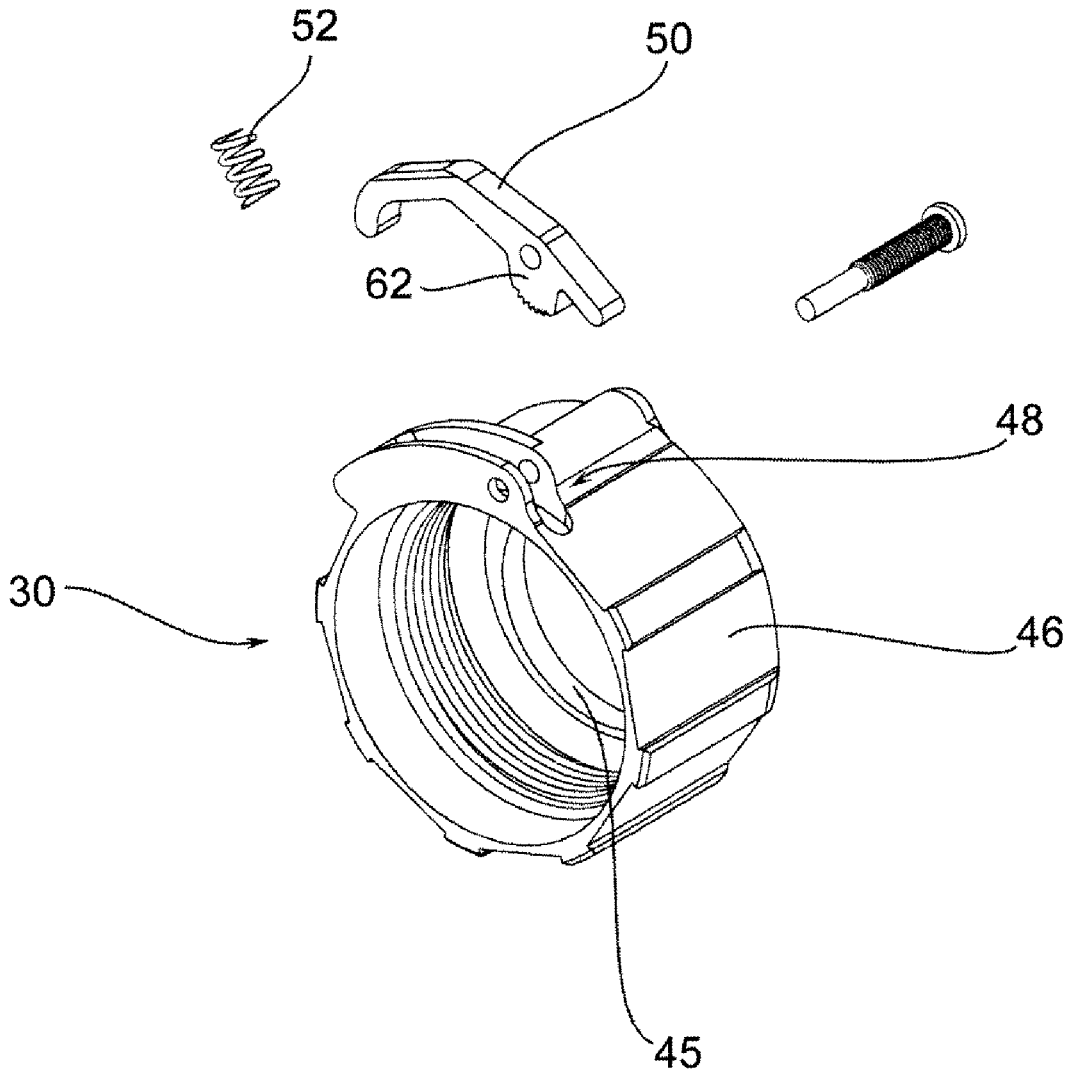
FIG. 3 shows an exploded view of a lock ring configured to be a portion of the firearm attachment.
Figure 4:
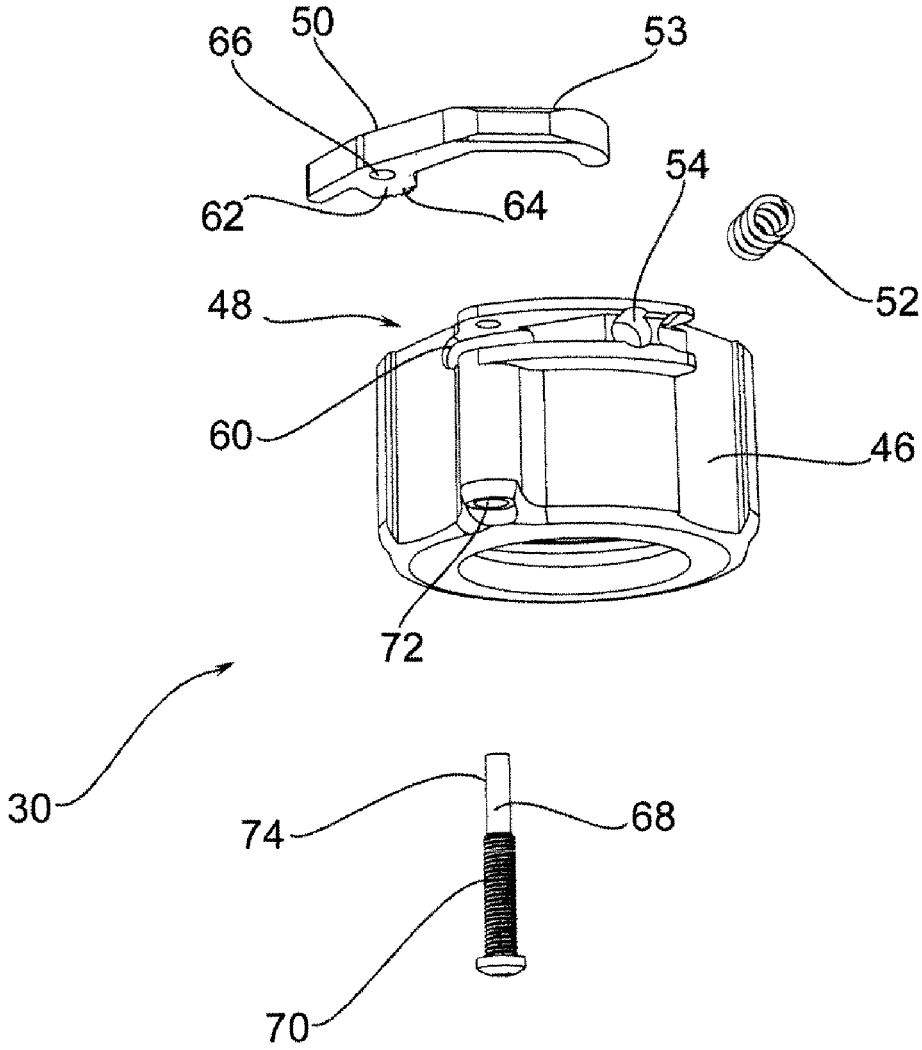
FIG. 4 shows another exploded view of a lock ring taken from a vantage point looking upon the fastener housing of the lock ring.

As shown in FIG. 3, the lock ring 30 is shown in an exploded view. In general, the lock ring 30 comprises a base ring 46 having a locking region 48. The locking region 48 is configured to have the lock-and-release lever 50 in a preferred form pivotally mounted thereto. As shown in FIG. 4, there is a isometric vantage point view looking at the locking region 48 where it can be seen that the biasing member 52, which in one form, can be a helical spring, which is configured to be fit within the surface defining a biasing member base 54 that can be an indentation roughly the diameter of the biasing member 52 so as to fit the biasing member 52 therein to be interposed between the lock-and-release lever 50 and the base ring 46.

The base ring 46 further comprises, in one form, a surface defining a lock opening 60 which is configured to allow the lock extension 62 of the lock lever to extend therethrough as shown, for example, in FIG. 2 in the lower right-hand portion. In general, the lock extension 62 comprises the lock engagement surface 64 which is operatively configured to engage the locking surface 42 as described further herein. The lock-and-release lever 50, in one form, is pivotally attached at the pivot attachment location 66, which is operatively configured to receive the fastener 68 (see FIG. 4). In general, the fastener 68 can be arranged in a plurality of forms, but in one preferred form, the threaded portion 70 can be received within the fastener housing 72 of the base ring 46 and the extension 74 extends through the attachment location 66 of the lock-and-release lever 50.

Figure 5:
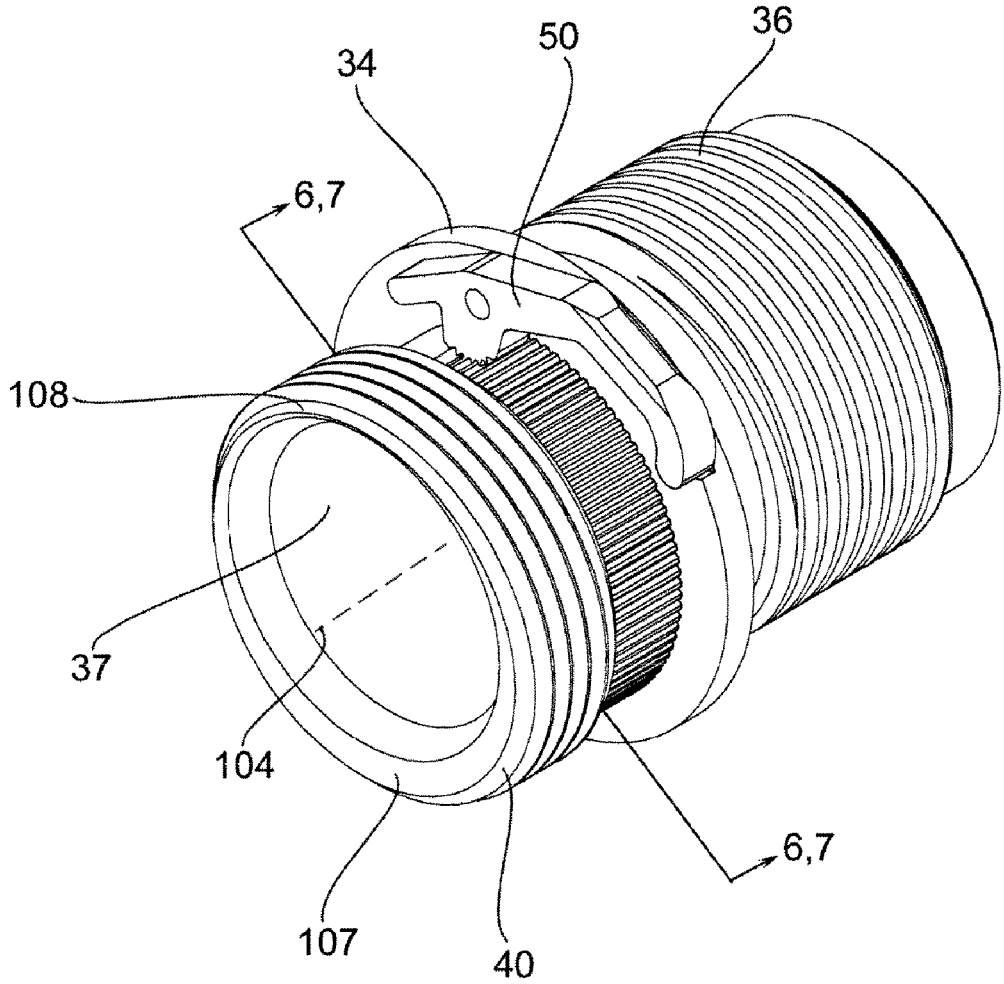
FIG. 5 shows a partial component view of the lock ring only showing the lock-and-release lever positioned in an engaged position with the lock surface of the base body, and is shown for illustrative purposes of describing one form of the mechanism where in operation, the lock-and-release lever would be pivotally attached to the lock ring which in turn is attached to the base body.
Figure 6:
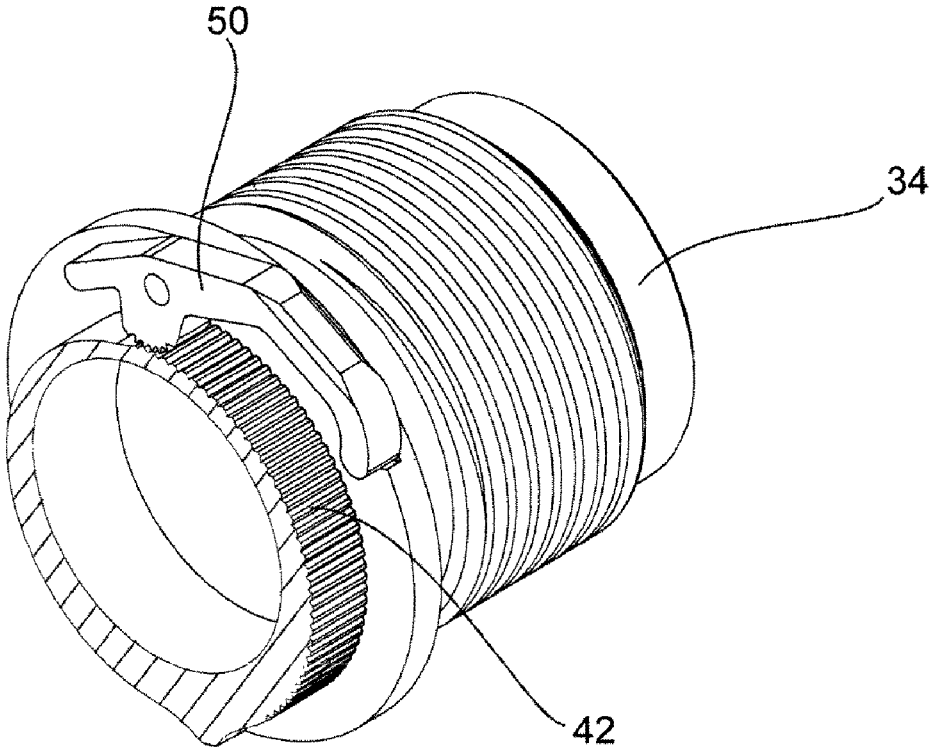
FIG. 6 shows the base body in a sectional view whereby the lock ring attachment region which in one form is threaded is thereby removed from view.

To further explain the dynamics of the engagement of the lock engagement surface 64, the lock-and-release lever 50, the base mount 34, and in particular the locking surface 42, reference is now made to the isometric view in FIG. 5, which only shows the base mount 34 with respect to the lock-and-release lever 50 when the lock lever is arranged in a locking orientation. It should be reiterated that the lock-and-release lever 50, in practice, is assembled to the base ring 46 to form a complete unit, as shown in FIG. 2. However, for purposes of explanation of the geometries, to simplify the discussion in FIGS. 5 and 7A-7G, the related structural components are not shown for purposes of simplicity of explanation. FIG. 5 shows the isometric view of the base mount 34 and the locking lever 50, where the cut line 6,7-6,7 provides a cut plane having a perpendicular axis in the longitudinal direction. FIG. 6 shows a sectional view where the lock ring attachment region 40 having the threaded portion of a larger diameter in one form is not shown. Now referring to FIG. 7A, it can be seen that there is a front view taken along the cut plane in FIG. 6, illustrating in detail the geometric relationship of the lock-and-release lever 50 and the locking surface 42 of the base mount 34. In general, the lock lever is provided with the biasing member 52, as shown in FIG. 3, to provide a torquing force upon the lock lever indicated by the vector 71 (see FIG. 7A). Of course, in the broader scope, a plurality of rotational forces can be applied upon the lock-and-release lever 50 in various configurations. A rotational torque on the lock-and-release lever 50 is one operational element to provide forceful engagement between the lock engagement surface 64 and the locking surface 42.

Figure 8:
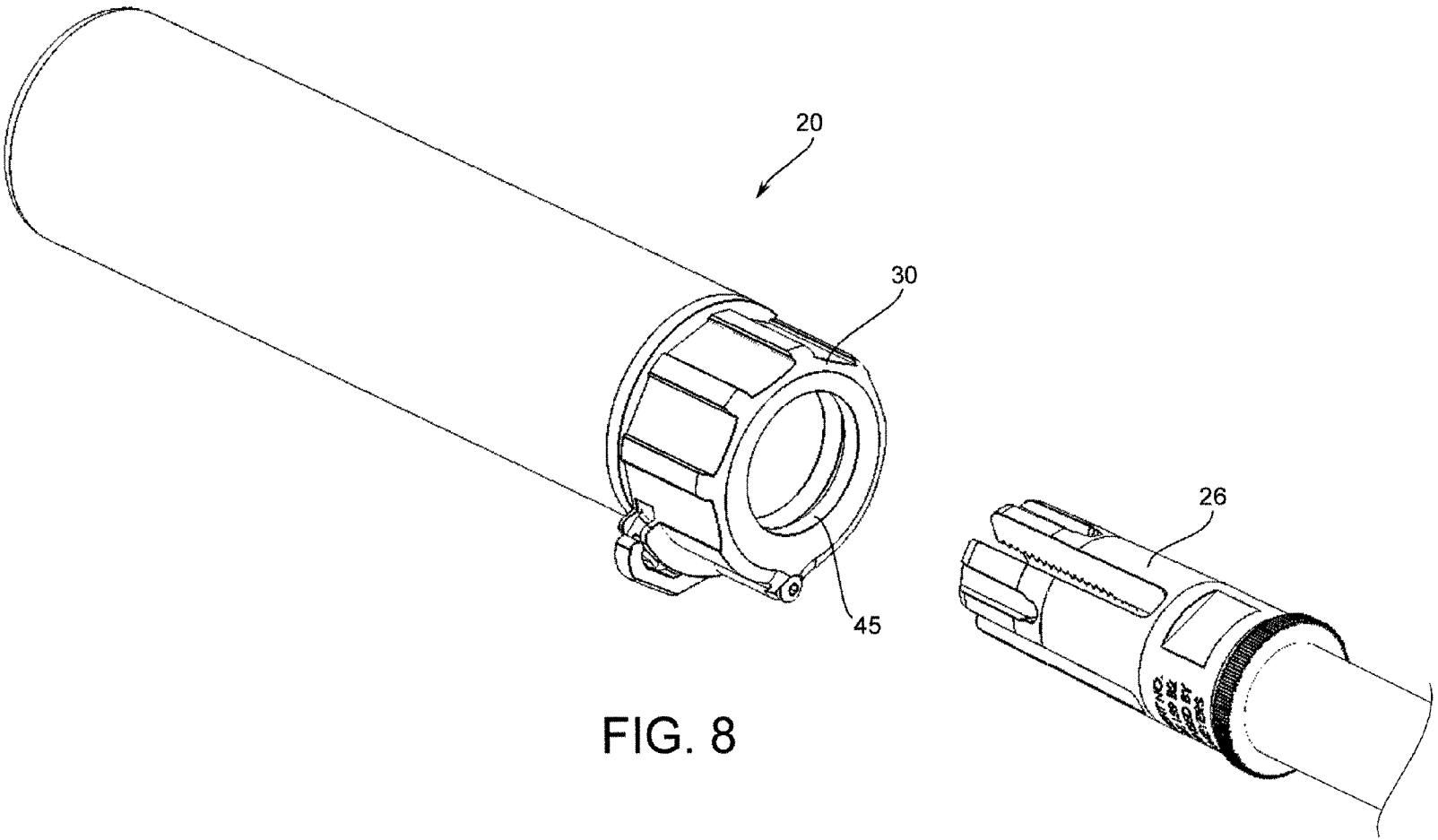
FIG. 8 shows the firearm attachment in an unlocked orientation positioned adjacent to the muzzle of a firearm.
Figure 9:
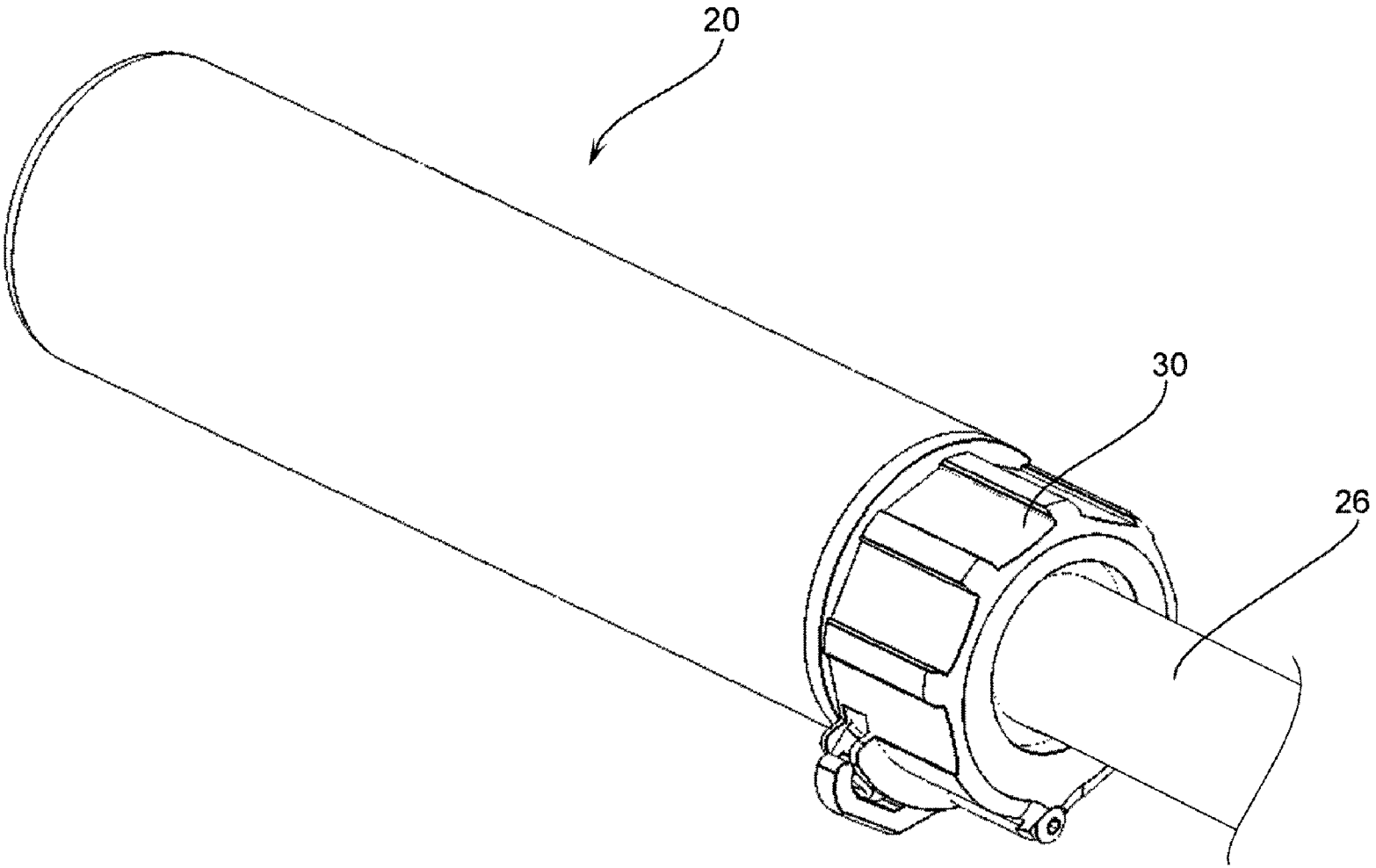
FIG. 9 shows the muzzle inserted into the firearm attachment with the lock ring in an unlocked orientation.
Figure 10:
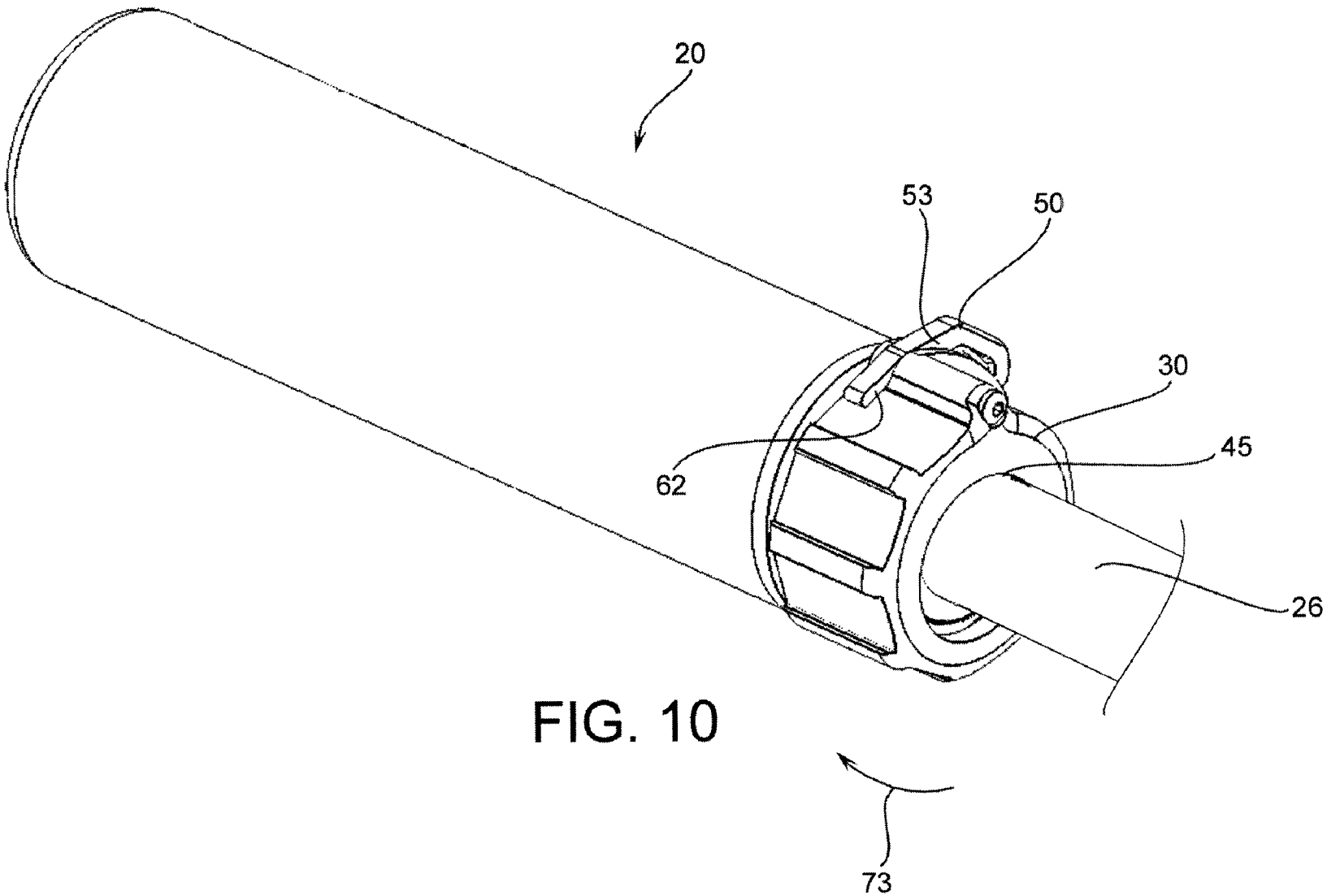
FIG. 10 shows a lock ring rotated into a locked orientation.

Before further describing the dynamics of the geometries, preferred orientations, and arrangement of the surfaces, there will first be an overview of the locking operation with reference to FIGS. 8-11. As shown in FIG. 8, the firearm attachment 20 is shown in an isometric view positioned adjacent to the muzzle 26 of a firearm. It should be noted that the orientation of FIG. 8 is an unlocked orientation of the locking assembly 22. The unlocked orientation is where the lock ring 30 is rotated counterclockwise (in one form) such that the non-concentric engagement surface 45 added above to FIG. 3 is in substantial alignment with the inner surface 37 which, in one form, is cylindrical of the base mount 34 (see FIG. 3). Now referring to FIG. 9, it can be seen that the muzzle 26 is inserted into the suppressor 20. Finally, FIG. 10 shows the lock ring 30 rotated counterclockwise from the perspective of the operator of the firearm (or, of course, the lock ring could be rotated clockwise with a symmetrically opposite arrangement). It can generally be seen that the non-concentric engagement surface 45 is now in tight frictional engagement with the muzzle 26 so as to rigidly attach to the suppressor 20 thereto. In one form, the frictional engagement of the non-concentric engagement surface 45 is such that experimentation has found that the suppressor will be rigidly mounted to the muzzle of a firearm given the geometries of the non-concentric engagement surface 45 described further herein. However, the lock-and-release lever 50 provides a secure engagement so as to ensure that the suppressor 20 is not removed from the firearm unless the release 53 of the lock-and-release lever 50 is pressed.

Referring back to FIG. 7A, it can be appreciated that, when in the locked orientation, the lock engagement surface 64 of the lock-and-release lever 50 in particular is provided with a plurality of engagement teeth 80, which can generally have the dimensions and properties of a knurled surface. In general, the plurality of engagement teeth 80 generally has a force engagement region 82 shown in FIG. 7A having a center of force generally indicated by the force vector 84. Therefore, it can be appreciated that the center of force vector 84 is positioned in the left-hand portion of the radial reference line 86. In other words, as the vector 71, which indicates the force of the biasing member 52 creating a moment upon the lever 50, forcefully engages the plurality of engagement teeth 80 upon the force engagement region 82, this force engagement region will not pass the radial reference line 86 so as to reduce the effect of the locking engagement between the lock engagement surface 64 and the locking surface 42 (the locking force between the lock ring 30 and the base mount 34).

Figure 7A:
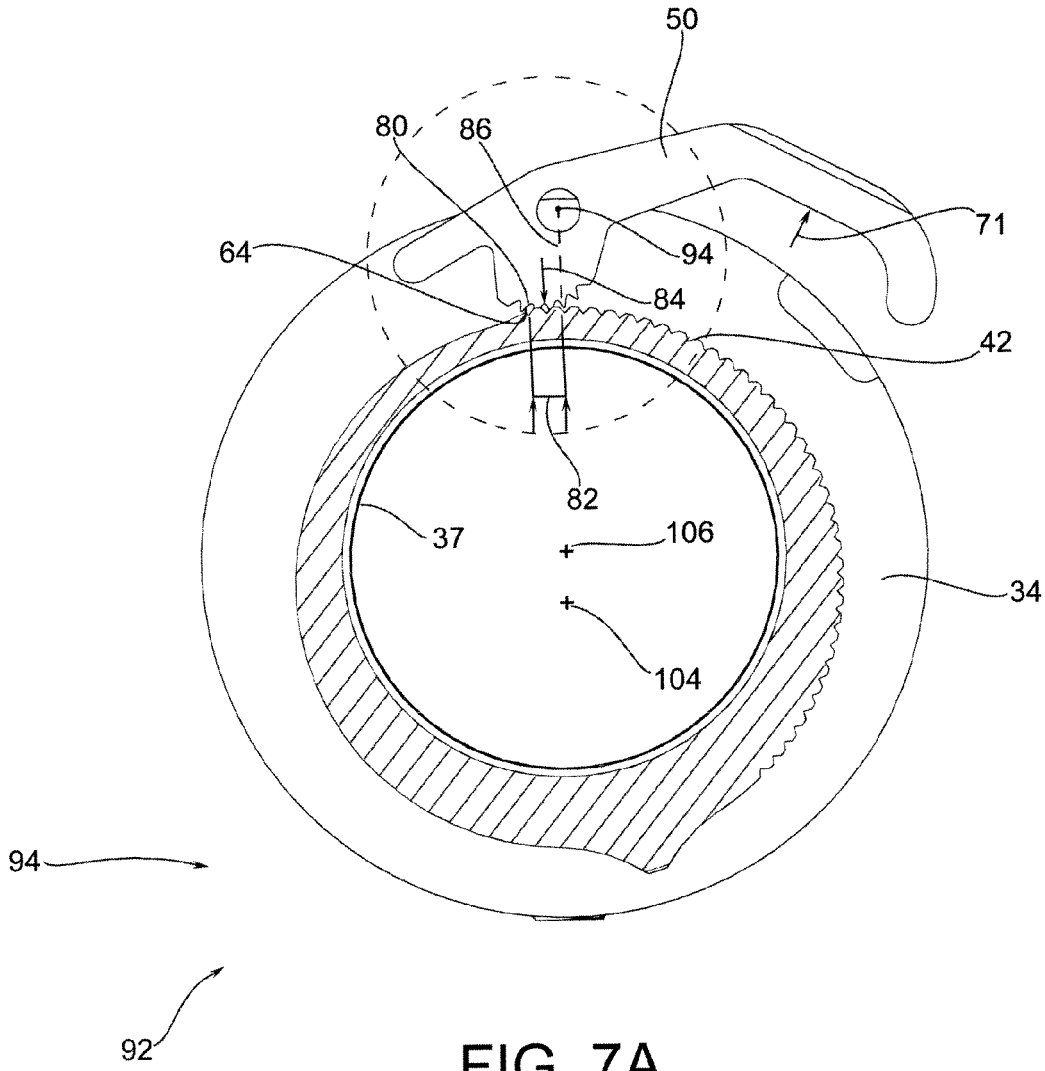
FIG. 7A is taken along line 7-7 of FIG. 5 where the engagement between the base body and the lock-and-release lever can be seen.
Figure 7B:
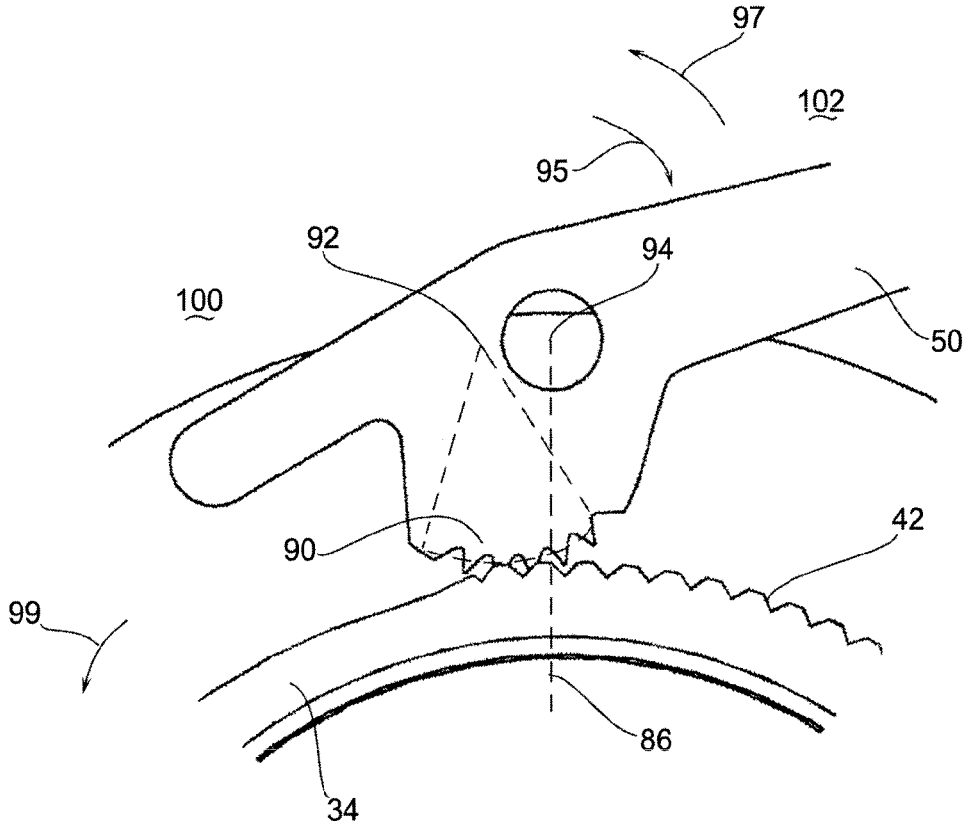
FIG. 7B shows a close-up view of the lock-and-release lever and, more specifically, one form of engagement of the lock engagement surface and the locking surface of the base body.

It should further be noted, as shown in FIG. 7B showing a close-up view of the plurality of engagement teeth, that the reference arc 90 generally has a center 92 that is non-concentric with the pivot mount providing a center of rotation 94 of the lock-and-release lever 50. As the lock lever rotates in the lock rotation 97 about the center of rotation 94, the lock engagement surface 64 is in greater forceful engagement with the locking surface 42. When the lock-and-release lever 50 is rotated in the unlock rotation 95, the surface 64 disengages to allow the lock ring 30 to rotate in the unlock direction 99. More specifically, the center 92 of the reference arc 90 is positioned in the same region as the center of force vector 84 with respect to the radial reference line 86. To aid in the description of the orientation of the rotation points and surface engagement regions, the region indicated at 100 is orientated in FIG. 7B to the left lower region of the radial reference line 86. The region 100 is defined as the lock maintenance region. The opposing region 102 which is shown in the right-hand portion of the radial reference line 86 is referred to as the unlock region. The radial reference line 86 is defined as the radially extending line intersecting the center of rotation 94 of the lock-and-release lever 50 to the center of rotation of the lock ring 104 as shown in FIG. 7A. In general, the center rotation of the lock ring 104 is the center of the lock ring attachment region 40 such as that shown in FIG. 5. It should be noted that the center longitudinal axis 106 as best shown in FIG. 7A is positioned above or otherwise offset from the center of rotation of the lock ring 104. Of course, in one form, the center longitudinal axis is positioned thereabove, but in other forms needs to be offset in a radial direction. The center longitudinal axis 106 is, in general, the geometric center of the muzzle. As seen in FIG. 5 the lock ring attachment region 40 is provided with threads rotating about the center of rotation and lock ring 104. These threads 40 are generally offset from threads providing the body attachment region 36. In other words, as shown in FIG. 5, the region indicated at 107 is thicker in the radial direction than the diametrically opposed region indicated at 108. Of course referring back to FIG. 2, it can further be appreciated that the lock ring is provided with the engagement surface 45 that is not concentric with the base mount attachment surface 110, which at one form is a threaded region to be threadedly attached to the lock ring attachment region 40 of the base mount 34.

Figure 7C:
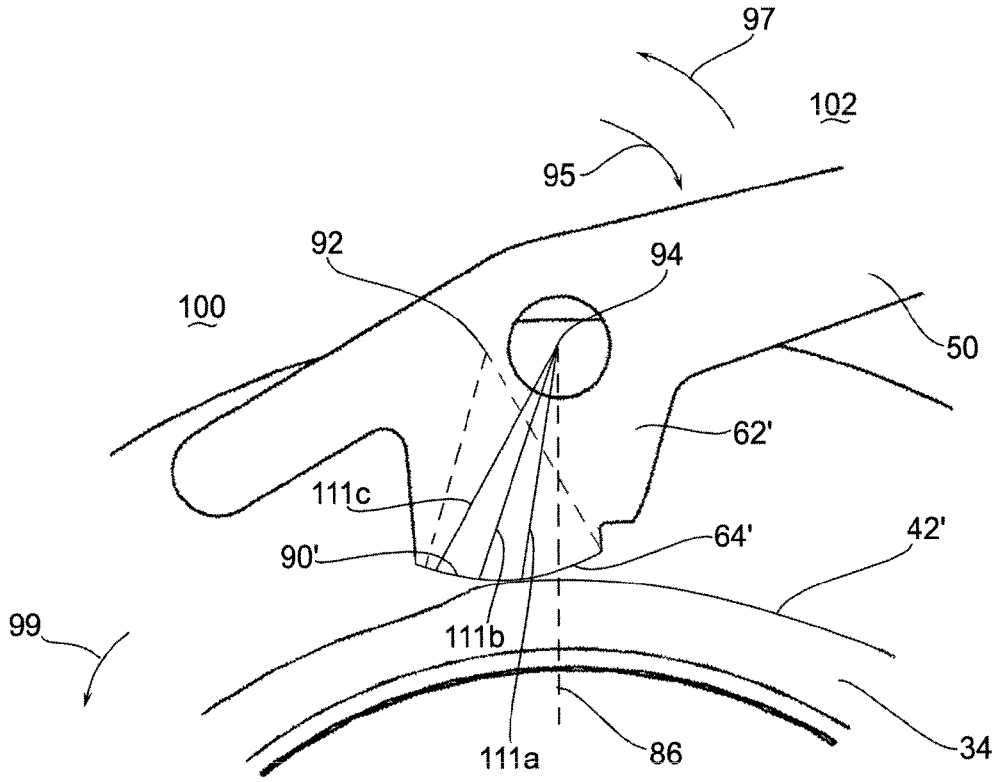
FIG. 7C shows another embodiment where the locking surface and the lock engagement surface in one form of a substantially smooth surface, and shows various distant vectors illustrating one form of a geometric relationship between these two surfaces.

Now referring to FIG. 7C there is shown another embodiment where the base reference arc 90' is coincident with the lock engagement surface 64'. Further, the locking surface 42' is now shown as a surface in one form without ridges. In general, when the locking ring is subjected to various external forces and vibrations to rotate the locking ring in an unlocked rotation indicated at the rotational vector 99, the frictional engagement between the lock extension 62' and the locking surface 42' is geometrically arranged as such to inhibit rotation unless the lock-and-release lever is pressed to disengage from the locking surface 42'. The center of base reference arc 92 is positioned in the lock maintenance region 100 which is the lateral region indicated in FIG. 7C from plane defined by radial reference line 86 and the longitudinal axis. FIG. 7C further shows another way of defining the base reference arc where the distance reference vectors 111*a*, 111*b*, and 111*c* are arranged so as to increase in length as these vectors advance toward the lock maintenance region 100. For purposes of disclosure, the distance reference vectors 111*a*, 111*b*, and 111*c* are to scale with respect to one another illustrating one form of a surface geometry to properly maintain the lock ring in a locked orientation. In other words, as the lock-and-release lever 50 rotates in the lock rotation 97, the distance between a forceful engagement between the surfaces 64' and 42' and the center of rotation 94 increases, thereby causing more force to be exerted between the lock-and-release lever 50 and the base mount 34.

Figure 7D:
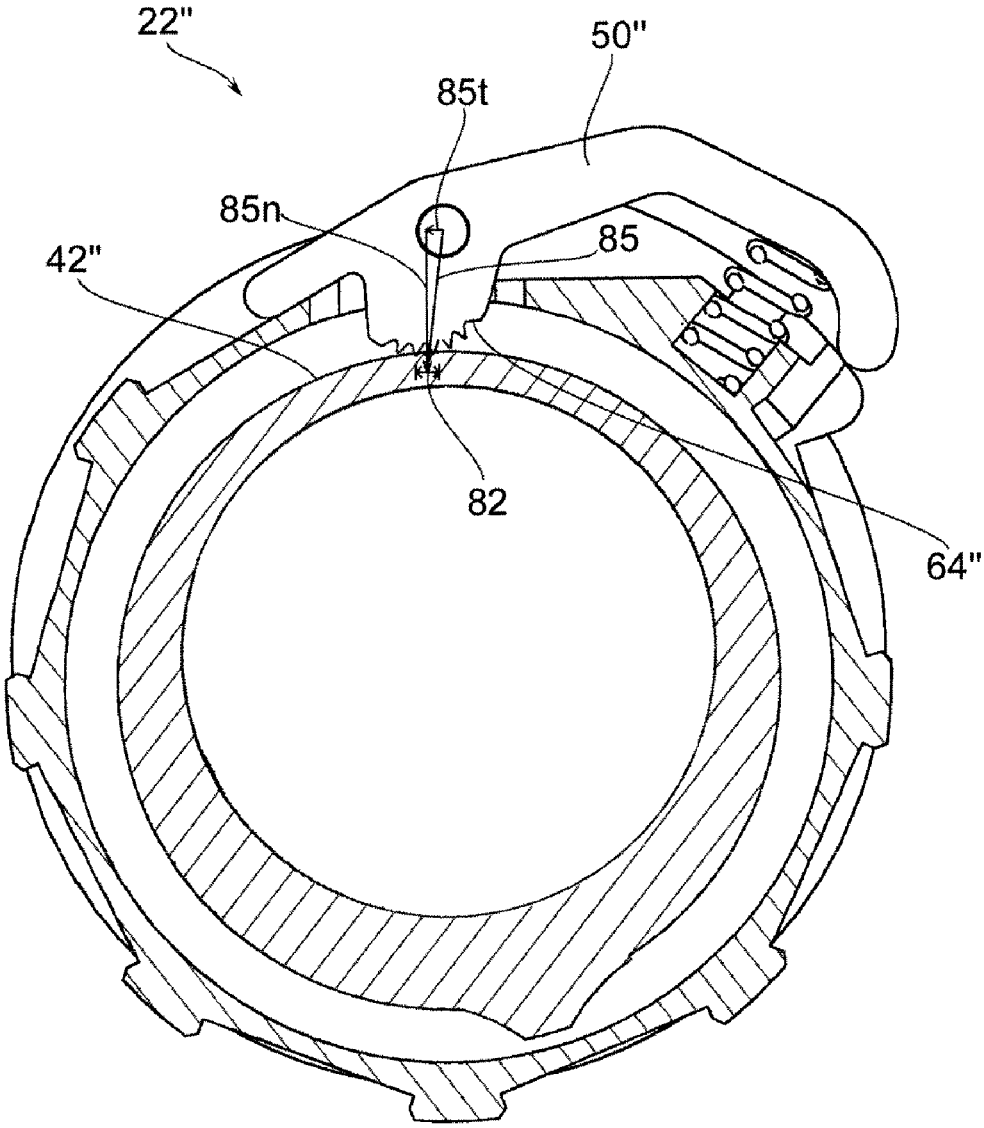
FIG. 7D shows another embodiment of an arrangement of surfaces between the lock engagement surface of the lock extension and the locking surface of the base body.

Now referring to FIG. 7D there is shown another form of carrying out the locking assembly 22". As shown in FIG. 7B, the locking lever 50" is substantially similar to the locking lever as shown in, for example, FIG. 7A. FIG. 7D shows a locking surface 42" which in this form is substantially smooth or otherwise provides fewer indentations than the locking surface 42 shown in FIG. 7A. With the correct geometries established between the locking lever 50' and the locking surface 42", a locked engagement can be provided where it can be appreciated that the amount of force exerted upon the locking surface 42" by the locking release lever 50" is indicated by the force vector 85. In general, the vector 85 is comprised of the vector components 85*n* and 85*t* to represent the normal and tangential components. As shown in FIG. 7D, the angle of vector 85*n* with respect to the vector 85 is approximately 10°. The rations of normal component 85*n* and an orthogonal tangential component 85*t* where the ratio of force values between the normal component to the tangential component is at least 5:1 or greater such as 10:1 and 20:1. In a broader range this angle can be between 2° and 25°. In general, the distribution of force of the vector 85 is located in the force engagement region 82 in a similar manner as discussed above with reference to FIG. 7A. Of course there is a certain amount of surface area engaging between the surfaces 64" and 42".

Figure 7E:
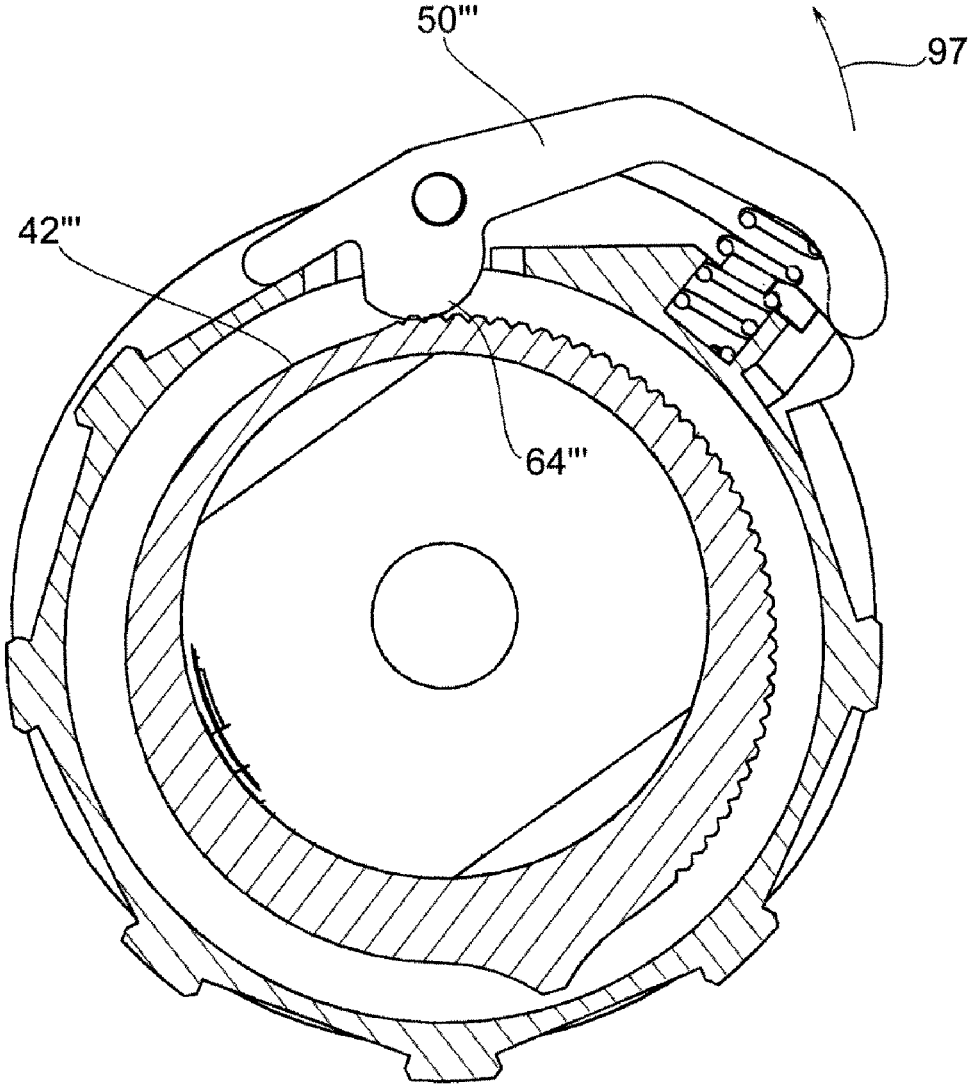
FIG. 7E shows another embodiment of different surface contours between the two main locking surfaces.
Figure 7F:
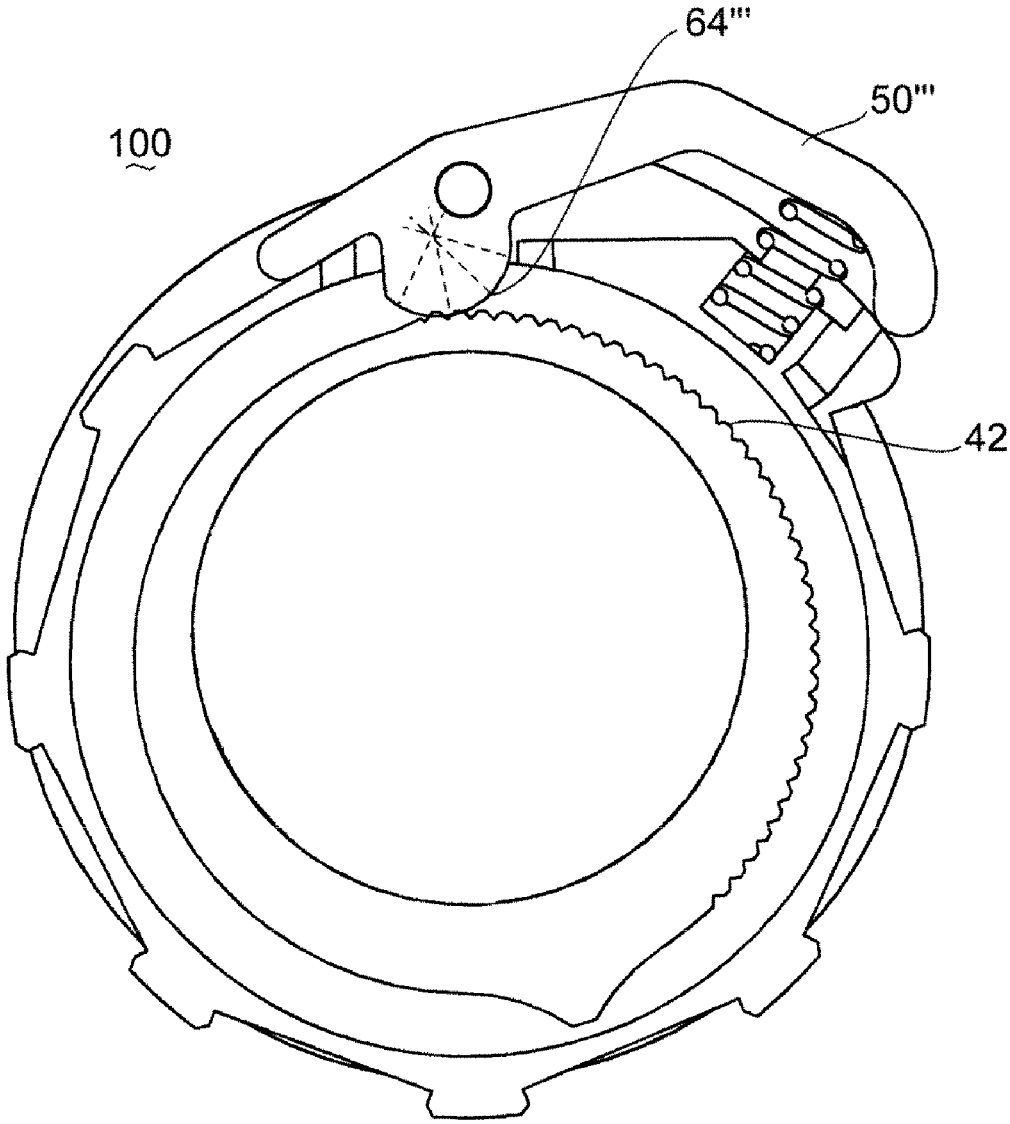
FIG. 7F shows another embodiment of an arrangement of a lock engagement surface of the lock-and-release lever.

Now referring to FIG. 7F, there is shown yet another variation where the locking engagement surface 64'" is similar to that shown in FIG. 7E, and the locking surface 42 is similar to that shown in FIG. 7A. In general, a plurality of types of engagement surfaces can be employed. In one form, the relationship between the surfaces generally shown as 42 and 64 (with various suffix indicators to illustrate different embodiments and variations) can be arranged. As noted above, the various surfaces with the prefix reference numeral 64 can have a center arc that is generally orientated in the lock maintenance region 100. FIG. 7F shows various hashed reference lines indicating the normal component of the surface 64'" in one form. Alternatively, as shown in FIG. 7C, the vectors 111 can increase in length (progressing from a greater length from 111*a* to 111*b* and a greater length from 11l*b* to 111*c*, etc.). The rate of increase of these vectors can be between 2.5%-6% per 10 degrees of rotation from the center of rotation 94 relative to the diameter of the locking surface 42. The coefficient of friction between the surfaces 64' and 42' have an effect upon the angle between the radial reference line 86 and the effect of contact between the surfaces 64' and 42' which is generally indicated at vector 111*a* which is approximately 10°. In one form, the various images in the figures are to proportional scale. In general, the embodiment as shown in FIG. 7C can operate where effectively the surfaces 64' and 42' are smooth. As the lock ring tightens, it is preferable to not have any backing out of the lock ring (or firearm attachment in the embodiment in FIG. 27) whereby providing teeth and a larger angle of say 45° between the pivot point 94 and the engagement of the surface 64' would be too great of an angle and engagement teeth would be necessary. The greater the size of the teeth the more potential for having the lock ring "back out" to fit the closest sized engagement of teeth members. If the teeth are finer to provide finer adjustment, they are more susceptible to failure by way of introducing material between the teeth such as dirt, corrosion or otherwise failure by way of shear stress.

Figure 7G:
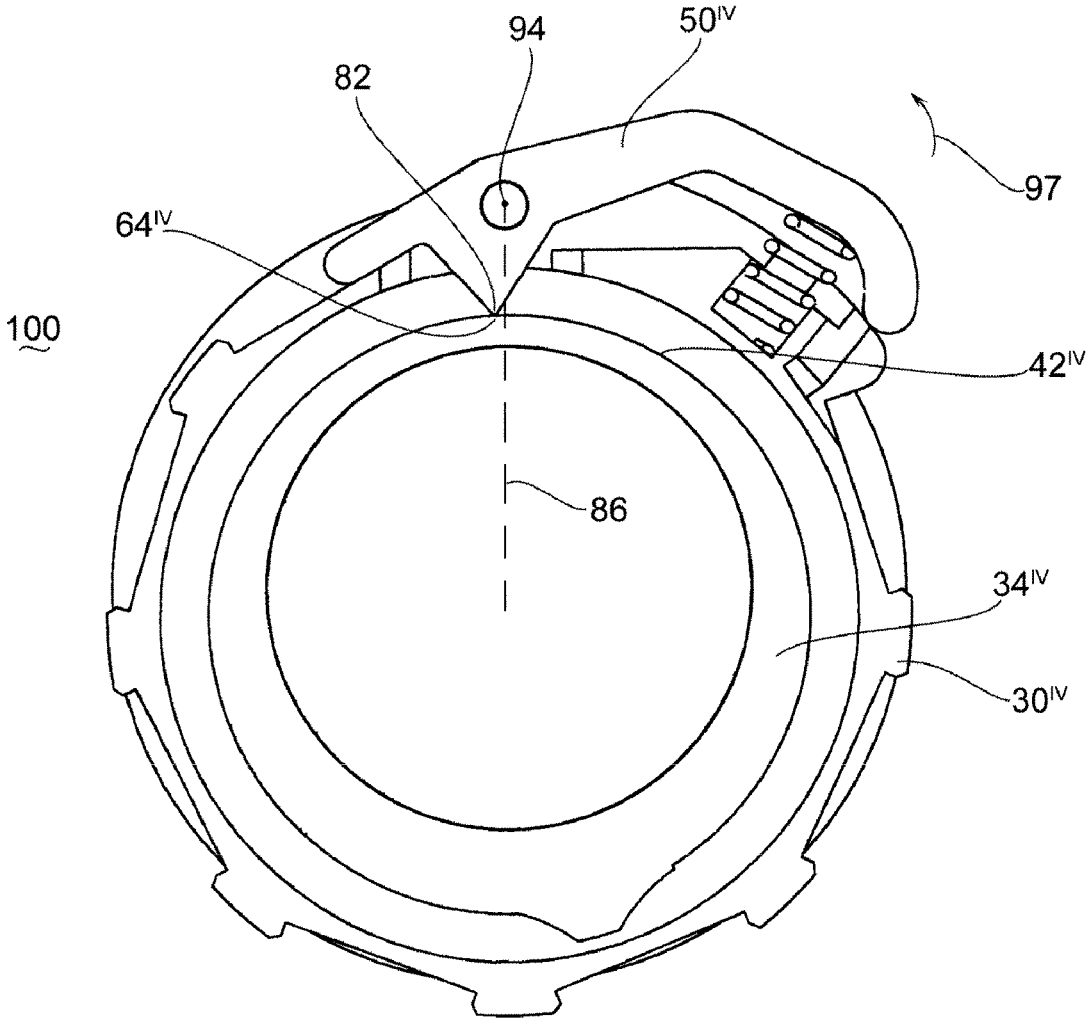
FIG. 7G shows another embodiment of a lock engagement surface having a finer point of contact which can be utilized in some forms.

Now referring to FIG. 7G there is shown yet another embodiment of a lock-and-release lever $\mathbf{50}^{IV}$, where in this form the locking engagement surface $\mathbf{64}^{IV}$ is arranged as more of a point. In this form, the engagement of the pointed portion at surface 64 to the locking surface $\mathbf{42}^{IV}$ is located in the lock maintenance region 100 (to the first lateral portion of the plane defined by the radial reference line 86 and the longitudinal axis). In this form, it can be appreciated that as the lock lever $\mathbf{50}^{IV}$ rotates in the lock rotation direction indicated 97, the point of contact between the lock lever and the base mount $\mathbf{34}^{IV}$ will provide forceful engagement to maintain the lock ring $\mathbf{30}^{IV}$ locked in place. Therefore, the embodiment in FIG. 7G basically shows a force engagement region 82 which is much smaller in tangential distance than that shown in, for example, FIG. 7A or FIG. 7D. Therefore, one form of defining the engagement is to provide the central portion of the force engagement region to be positioned so as to not rotate past top dead center of the center of rotation 94 of the lock-and-release lever $\mathbf{50}^{IV}$. In one form, the angle from the radial reference line to the center of the force engagement region 82 is based from the center of rotation point 94 and is less than 10°, and in a broader range this value is less than 2° to 25°. A preferred range is approximately 7° plus or minus 20 percent.

Figure 11:
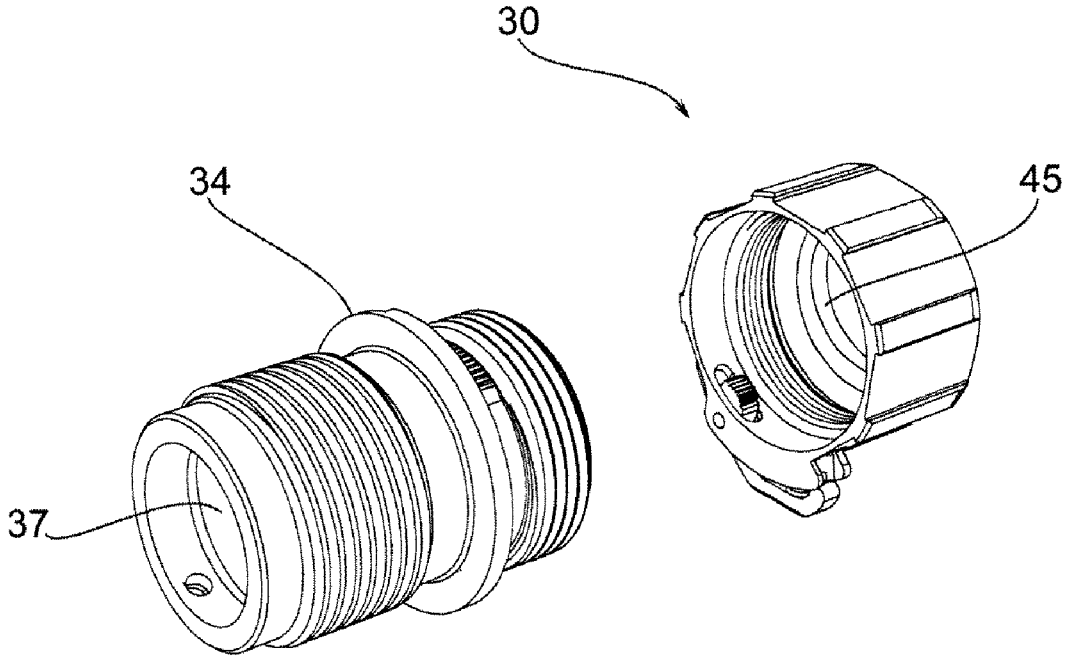
FIG. 11 shows the lock ring disengaged from the base body showing one form of providing a rotating lock member.
Figure 12:
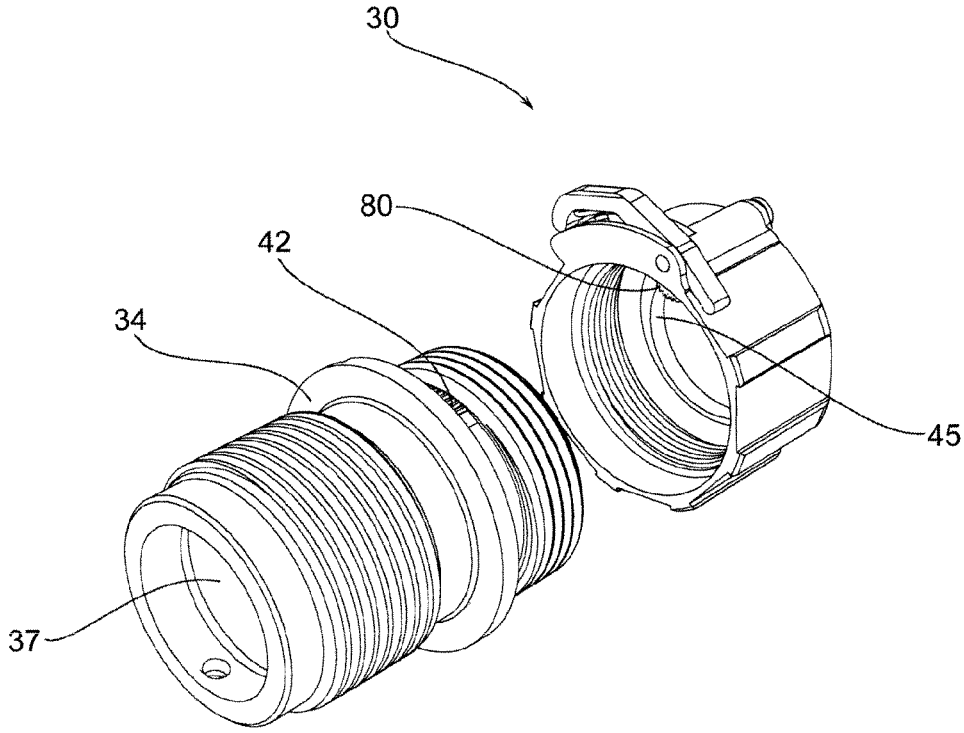
FIG. 12 shows a lock ring still positioned in an exploded view with respect to the base body, except the lock ring is now rotated into a locking orientation along the central longitudinal mutual axis between the lock ring and the base body.

FIG. 11 shows the locking ring 30 in an exploded view with respect to the base mount 34. In general, it can be appreciated that, in this orientation, the non-concentric engagement surface 45 of the lock ring is in substantial alignment with the cylindrical surface 37 of the base mount 34. In other words, the central axes of the surfaces 45 and 37 are substantially co-linear, and the cylindrical surfaces 37 and 45 (cylindrical in one form) are of substantially the same diameter. Now referring to FIG. 12, it can be seen that the lock ring 30 is now rotated substantially 180° or a lesser amount of rotation than 180° in a preferred form, and it can be appreciated that the non-concentric engagement surface 45 is now in one form still parallel to the central axis of the cylindrical surface 37 of the base mount 34, but is offset in this case in the vertically downward direction (but in general offset in any radial direction). It further can be noted in FIG. 12 that if the components 30 and 34 were assembled, the plurality of engagement teeth 80 would now be in engagement with the locking surface 42.

Figure 13:
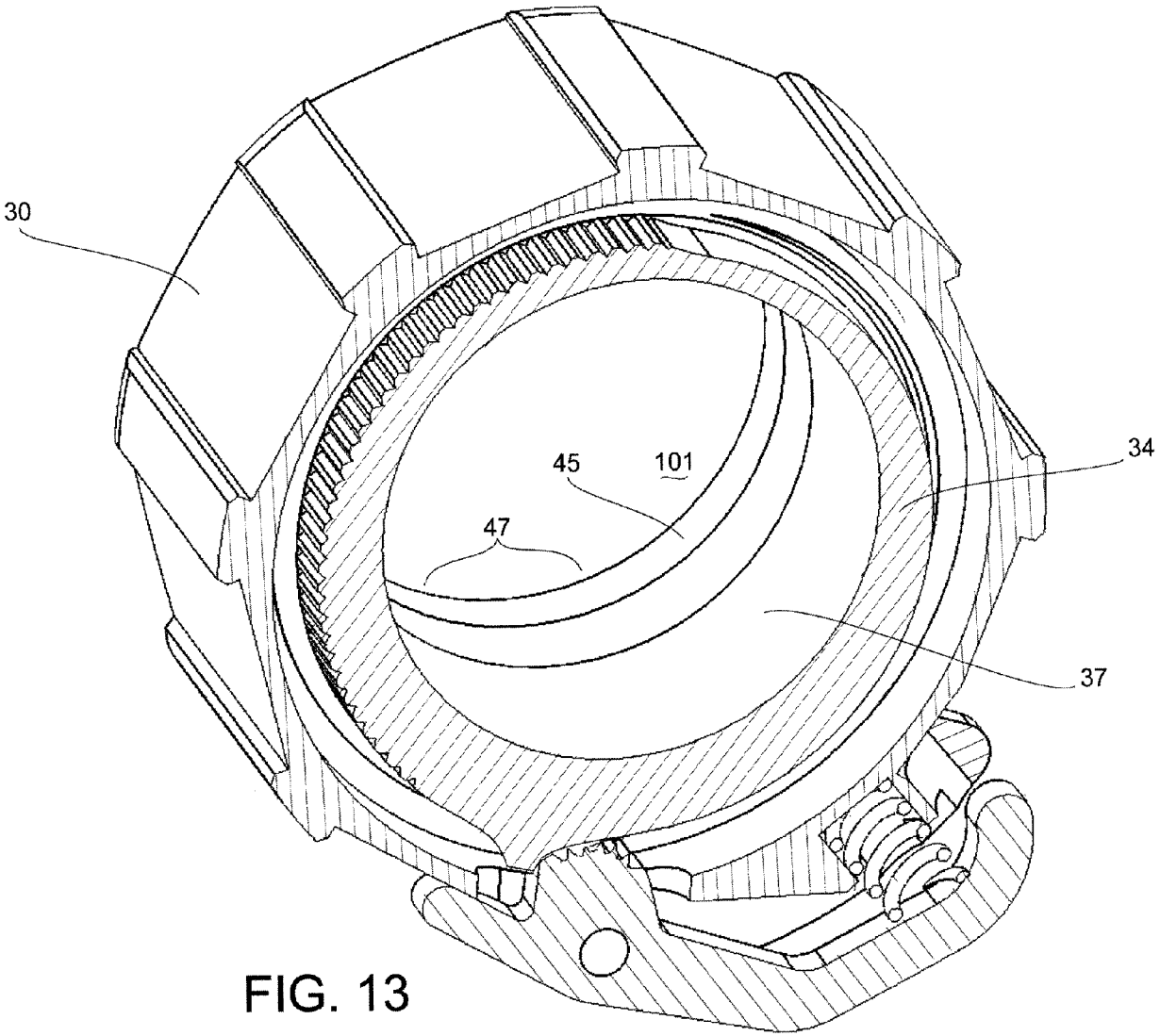
FIG. 13 shows an isometric sectional view of the lock ring engaging the base body.
Figure 14:
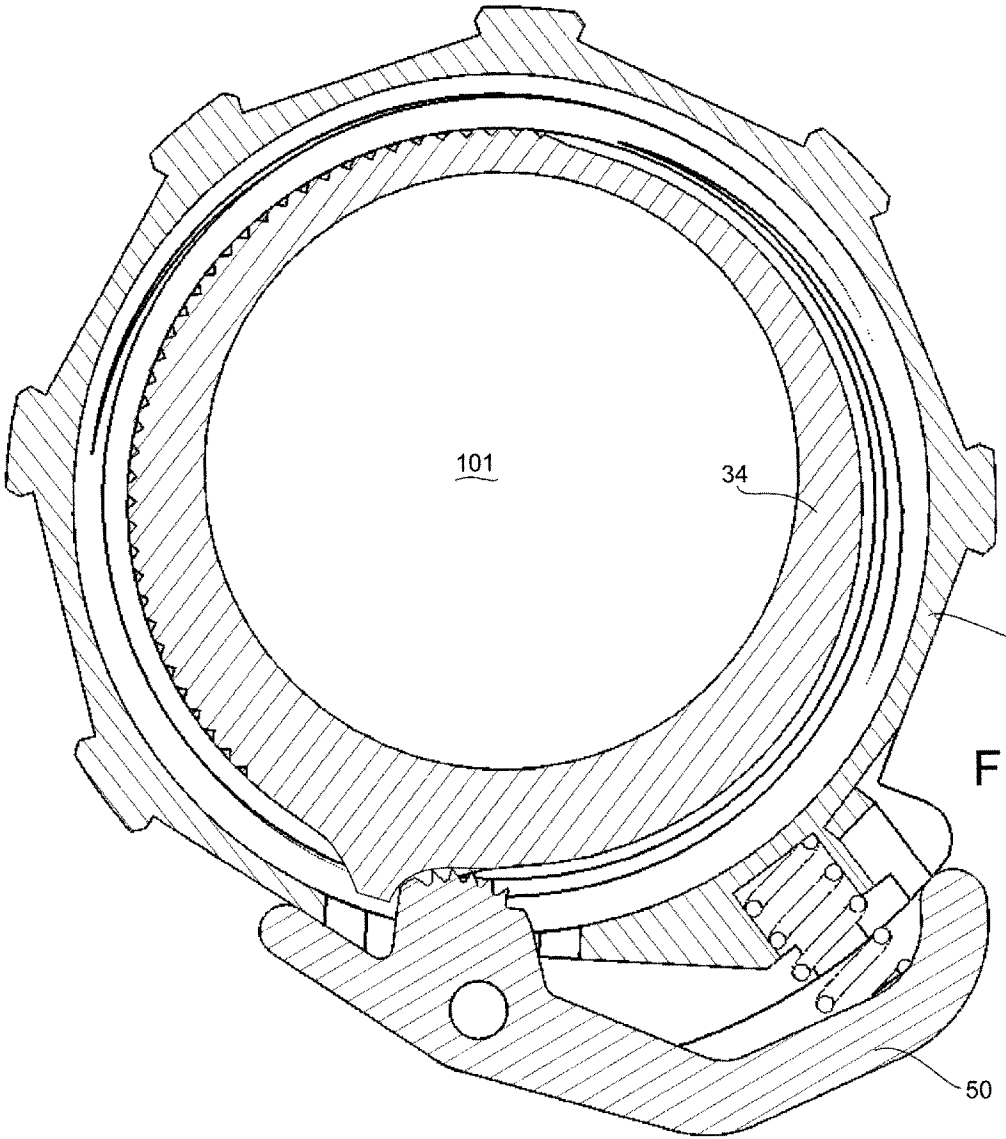
FIG. 14 shows a similar orientation of components of FIG. 13, except in a view taken along the longitudinal axis where the central open area is arranged to have a muzzle pass therethrough and the components are in an unlocked orientation.
Figure 15:
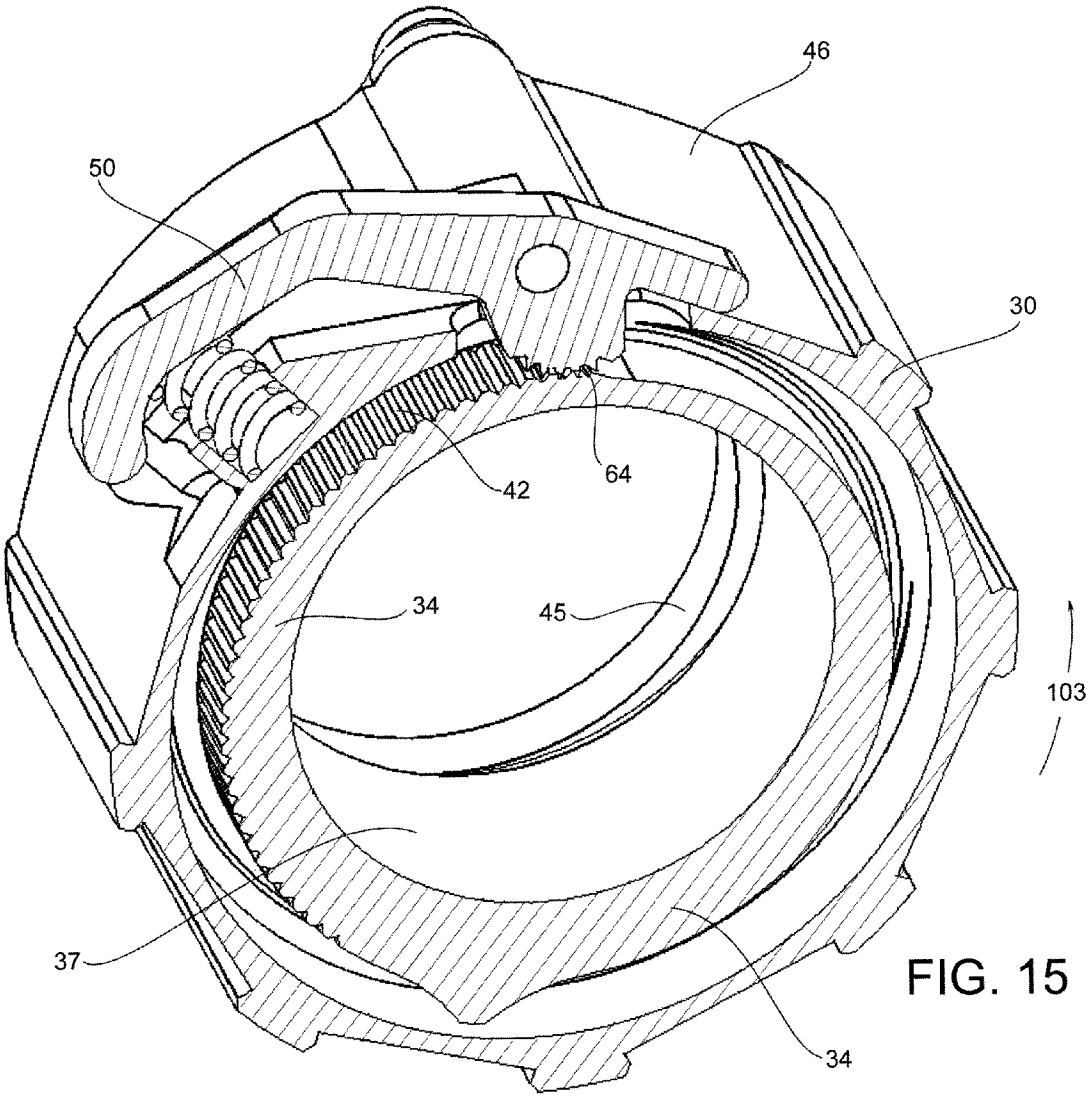
FIG. 15 is a sectional isometric view similar to that of FIG. 13 except the lock ring is now positioned in a locked orientation with respect to the base body.
Figure 16:
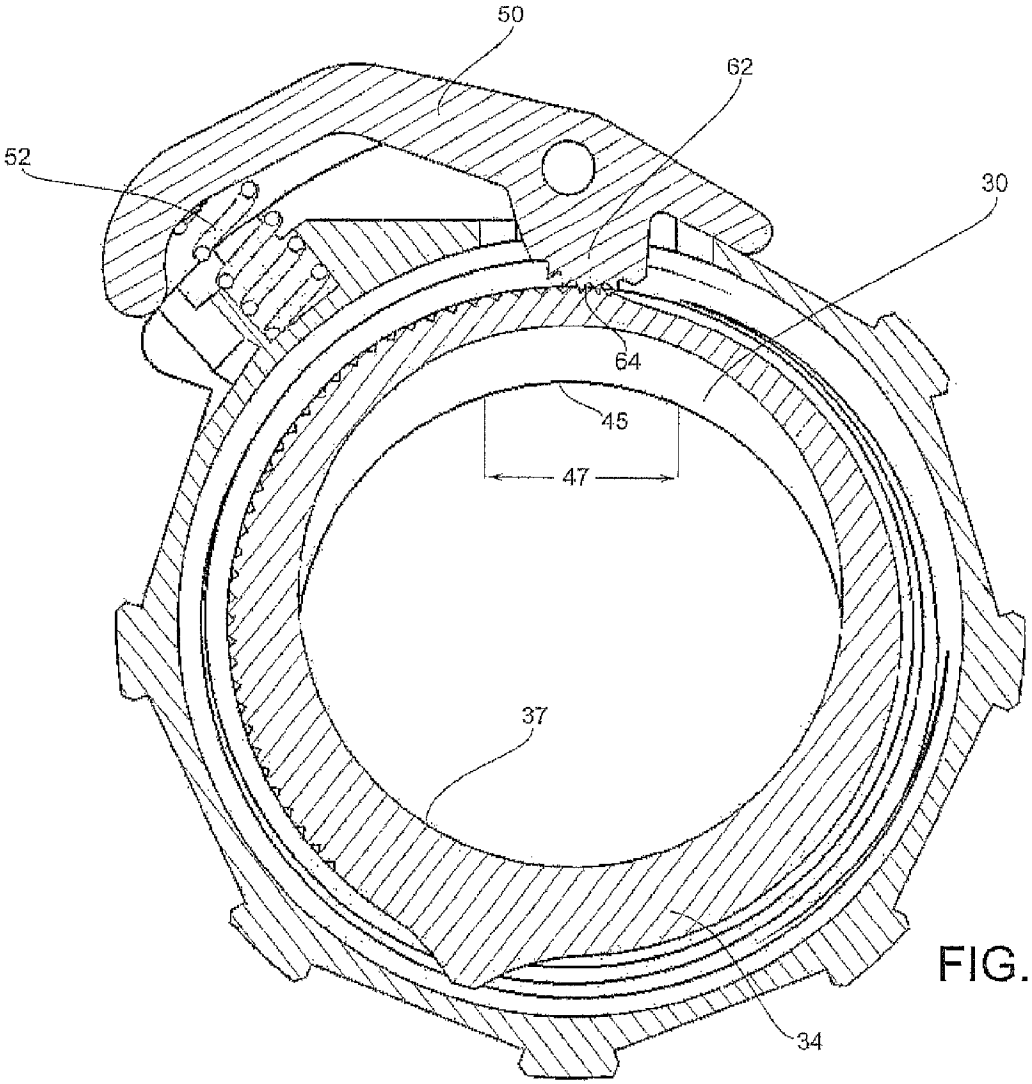
FIG. 16 is a view of the orientation of components in FIG. 15 except taken along the longitudinal axis where it can be seen that the non-concentric engagement surface is repositioned in the manner so as to forcefully engage the muzzle of a firearm, which can be the barrel or the muzzle attachment such as a flash suppressor or any other end portion of the muzzle region of the firearm.

FIG. 13 further shows a sectional view showing the base mount 34 in cross-section showing that the inner surface 37 of the base mount is substantially in-line with the non-concentric engagement surface 45 of the lock ring 30. FIG. 14 shows the sectional view in a non-isometric format directly along the longitudinal axis, illustrating the central open area 101, which is generally defined between the surfaces 37 and 45 of FIG. 13. It can be appreciated that the outer substantially conical surface of the muzzle 26 as shown in FIG. 1 is operatively configured to fit within the central open area 100. Now referring to the isometric view of FIG. 15, it can be appreciated that the lock ring 30 is rotated in the direction indicated by the rotational vector 103 so the lock-and-release lever 50 is now providing the lock engagement surface 64 to be engaged with the locking surface 42 of the base mount 34. As can be generally seen in FIG. 15, the non-concentric engagement surface 45 of the lock ring 30 and more particularly the solid unitary structure of the base ring 46 is now repositioned so as to no longer be in alignment with the inner surface 37 of the base mount 34. As better shown in FIG. 16, it can be seen that the non-concentric engagement surface 45 is now offset from the inner surface 37 of the base mount 34. More specifically, the muzzle engagement region 47 as shown in FIG. 16 is a portion of the non-concentric engagement surface 45, which is in forceful engagement with the outer surface of the muzzle (which broadly includes the barrel, a flash suppressor or any portion of the gun itself), and more particularly in engagement at the lock surface region 29 as shown in FIG. 1. Further, the opposing surface region upon the inner surface 37 of the base mount 34 has the more longitudinally forward and lower region of the muzzle forcefully engaged therewith to provide a lock between the suppressor 20 and the muzzle 26 of the firearm (see FIG. 1).

Figure 17:
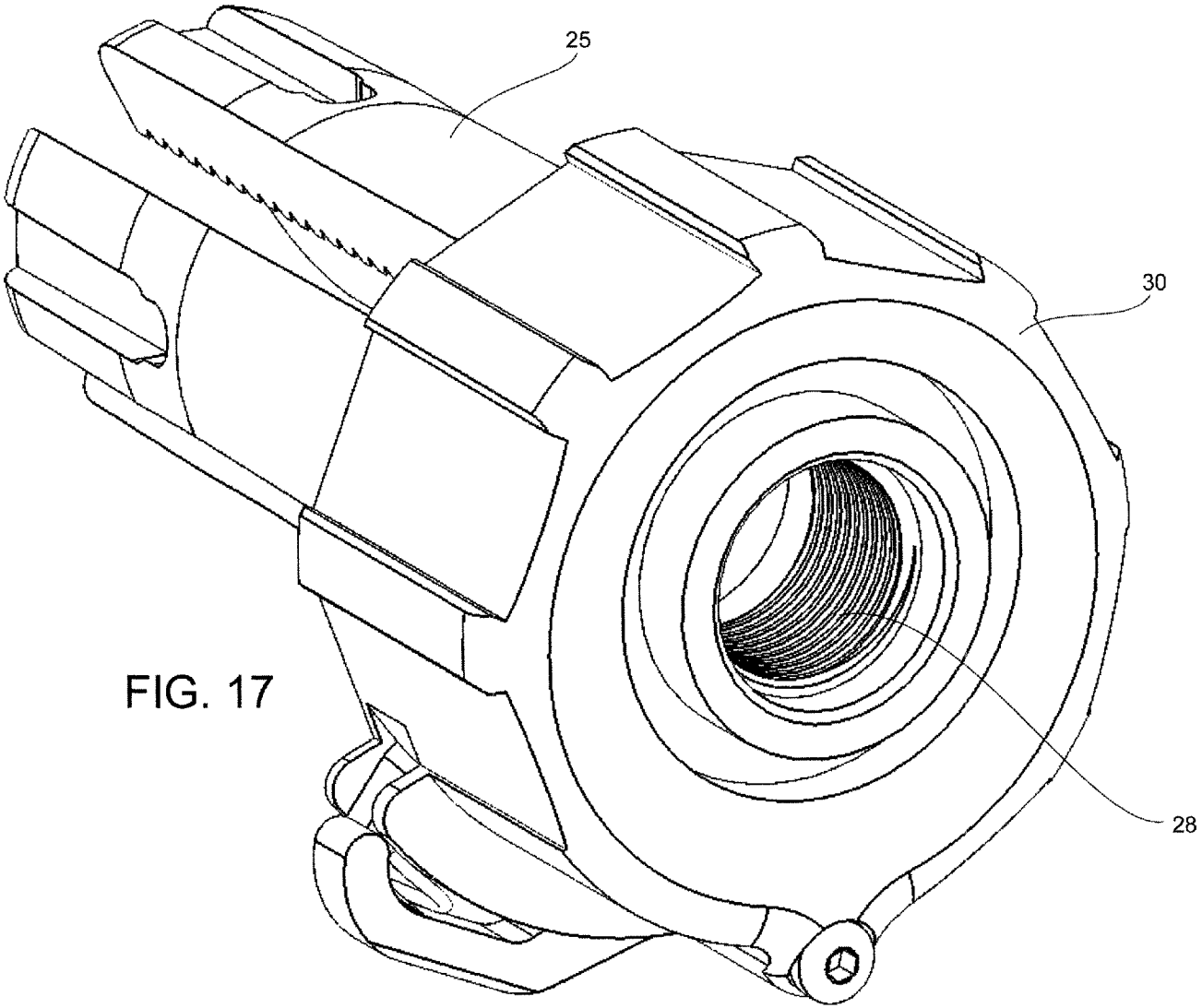
FIG. 17 shows a portion of a muzzle in one form which is a threaded flash suppressor positioned in the lock ring where it can generally be seen that the lock ring is positioned in the unlocked orientation and the front central opening of the lock ring having a center axis is substantially co-linear with the central axis of the muzzle.
Figure 18:
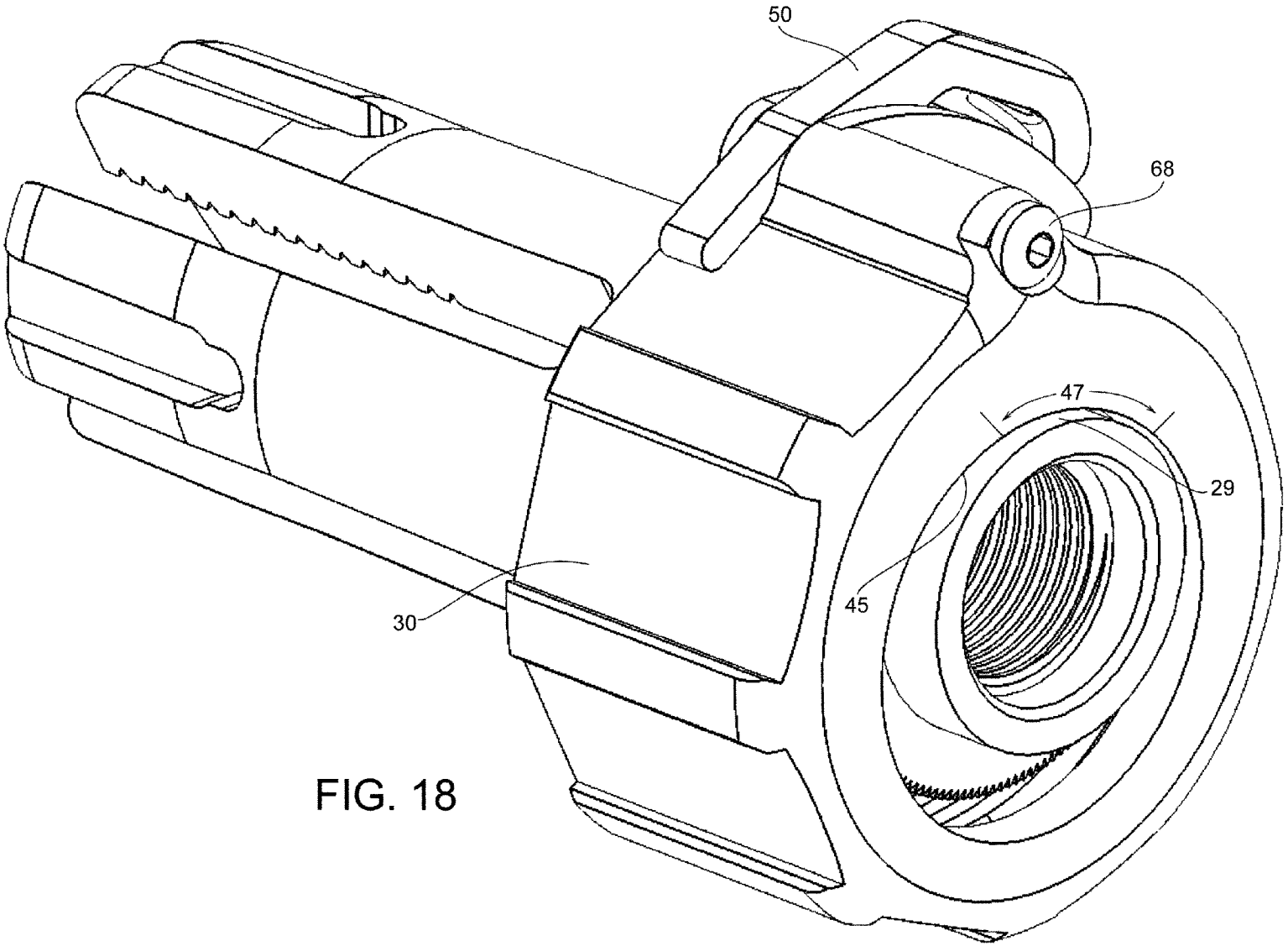
FIG. 18 shows the lock ring rotated into a locked orientation where the central axis of the front opening of the lock ring is now positioned offset from co-linear and substantially parallel from the central axis of the muzzle where the engagement region is generally shown to be in forceful engagement with the muzzle, which in one form is shown here as the threaded adapter, such as a flash suppressor.

Now referring to FIG. 17, there is shown a flash suppressor 25 which in one form is a portion of the muzzle 26 as shown in FIG. 1. In general, other types of muzzle end portions of a firearm can be utilized other than a flash suppressor, but for purposes of explanation, a flash suppressor having the threaded engagement portion 28 will be described as a mount portion for a firearm. In general, FIG. 17 shows only the lock ring 30 in the unlocked orientation. Now referring to FIG. 18, there is shown the lock ring 30 in the locked orientation, where it can be generally appreciated that the muzzle engagement region 47 of the non-concentric engagement surface 45 of the lock ring 30 is in tight virtual engagement with the lock surface region 29.

With the foregoing description in place, there will now be a description of another type of attachment for a firearm, referred to as a blank firing adapter 120 as shown in FIG. 19. In general, the blank firing adapter can be utilized with the locking assembly 22" as described in detail above, or other types of locking assemblies. Further, it should be reiterated that the locking assembly 22 as described in detail above can be utilized with any type of attachment to a firearm, such as a suppressor, blank firing assembly, flash suppressor, or even other types of devices herein not commonly utilized attached to a muzzle, such as an illuminating device, a blunt trauma impact attachment device, or other type of mechanism sought after to be rigidly attached to the end muzzle portion of a firearm, including long guns and pistols.

Figure 20:
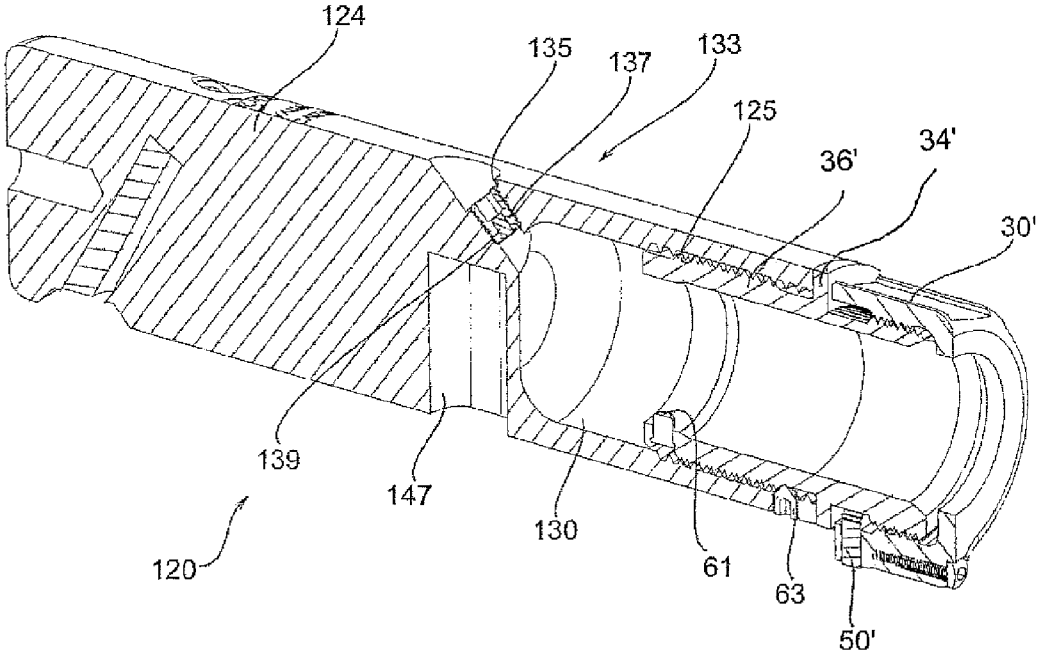
FIG. 20 shows a cross-sectional view taken along the plane in the lateral and vertical directions taken at line 20,21-20,21 of FIG. 19.

Referring now to FIG. 20, there is shown an isometric view in cross-section of the blank firing adapter 120. In general, the blank firing adapter 120 comprises, in one form, similar components of the base mount 34' and the lock ring 30' as described above, which comprises the lock-and-release lever 50. It should be noted that in one form, the base mount 34' can be provided with an extension 61 which can, for example, be a set screw which is operatively configured to be fitted to a surface defining a longitudinally extending slide or slot in the muzzle 26 (see FIG. 24). Further, a lock member 63 can be employed, such as a set screw, to rigidly attach the base mount 34' to the main body 124 (as well as the base mount 34 to the suppressor body 24 as shown in FIGS. 1 and 2).

FIG. 20 generally shows the main body 124 as a unitary structure in one form, where a surface defining an interior chamber 130 is present. In one form, a portion of this chamber in the longitudinally rearward region provides a base attachment 125 which can be a female threaded attachment configured to engage the body attachment region 36' of the base mount 34'. The interior chamber 130 is provided with a bleed port 135 which provides access to the interior chamber and, in one form, is provided with a fitting module, such as threads, to fit a common hexagonal thread pattern to be received by, for example, a hex screw. In general, the insert 137 operates as a bleed for adjusting the amount and volumetric rate of escaping gas therethrough when a blank cartridge is fired to the firearm. The surface defining the bleed orifice 139 can be adjusted and calibrated based on various parameters of the barrel length, the charge of the combusted material in the blank such as the burn rate and total amount of the powder contained therein, and other factors. In general, a plurality of inserts with a properly sized bleed orifice that provides cycling of the semiautomatic weapon without excessive gas blowback can be chosen for operation. At any rate, the bleed insert 137 provides adjustability of the escaping gas exiting the muzzle. Of course in the broader scope, other types of bleed adjustment systems 133 can be implemented, such as a dynamic iris-type system, a recessed screw having a frustoconical end adjusting the toroidal-shaped opening between the screw and an outer housing, a plurality of openings that can be selectively opened to provide access to the interior chamber 130, and a plurality of other mechanisms for adjusting the opening to allow gas to escape. It should be noted that in one form, a bleed port 135 is pointed upwardly and forwardly. Of course this port could be oriented in a number of orientations; however, ejecting the gas upwardly, can aid in preventing a certain amount of muzzle lift.

As further shown in FIG. 20, there is a surface defining an escape port 147. As shown in the view taken along the lateral axis in FIG. 21, it can be appreciated that the escape port 147 is comprised of a longitudinally trailing surface 149 and a longitudinally forward surface 151. Further, the escape port 147 is provided with the barrier 153 which separates the escape port 147 from the interior chamber 130. In normal operation, expanding gas entering the interior chamber 130 will exit through the bleed adjustment system 133 in a manner as described above. However, in the event that the operator of the firearm places a live round into the chamber and initiates the firing sequence, a bullet will travel at a very high velocity (several thousand feet per second with a rifle) down the barrel, out the muzzle and be ejected into the blank firing adapter 120. In one form the projectile receiving area is operatively configured to have three rounds of a projectile weighing no more than 80 grams traveling at not greater than 3000 feet per second be contained therein when fired from the firearm. It is fairly obvious that the blank firing adapter 120 is not intended to have bullets passing therethrough in normal operation; however, the adapter 120 is designed with safety features to warn the operator of the firearm that a live round is being shot, and further mitigate damage from the live round which has been fired. In normal operation, the blank firing adapter will produce a sound of approximately 128dB. If a live round were to pass into the blank firing adapter 120 the sound would escalate in one form to 154dB. In normal operation the volume of sound is attributed to a portion of the gas exiting through the bleed adjustment system 133, as well as other noises created from the operation of the firearm and bleeding gas through other portions, such as the gas return line to operate the bolt of the firearm. The barrier 153 has a thickness to allow the projectile to break therethrough. In one form the barrier has a thickness of 0.100 of an inch. The broader range can be 0.030" to 0.700" in a preferred form. The material in one form is aluminum 7075 or other materials having a strength range sufficient to slow projectiles and preferably allow them to eject downwardly. The material further being configured to have the projectile bullet pierced through the barrier 153 thereby causing sound to be emitted from the escape port 147. In general, the decibel rating of a bullet actually passing through the barrier 153 is much greater (e.g. greater than 10dB from normal operation) than when a blank is fired to provide an audio signature to the shooter that something is wrong.

Figure 21:
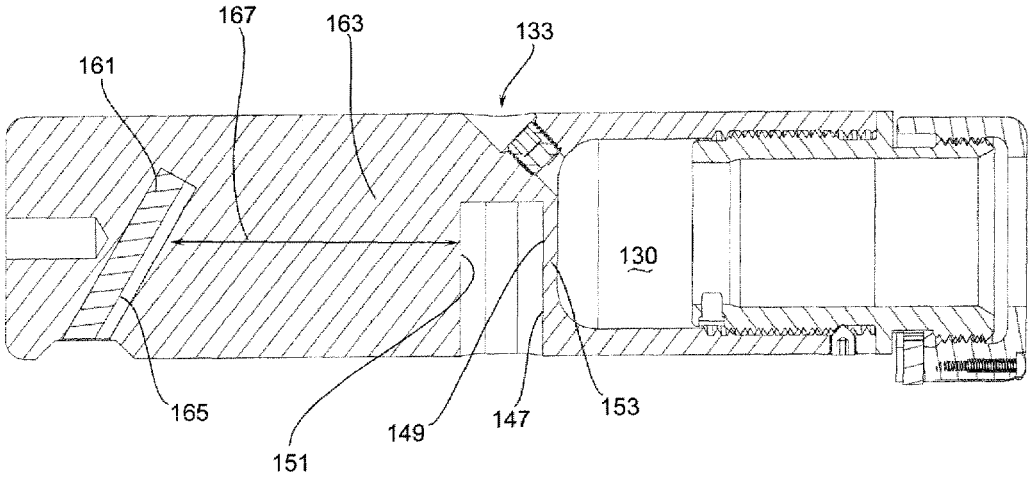
FIG. 21 is a sectional view of the firearm blank firing adapter taken along the lines 20,21-20,21 of FIG. 19.

As further shown in FIG. 21, there is a projectile redirection plate 161 fitted in a longitudinally forward portion of the main body 124. If multiple rounds are fired, the projectile receiving area 163 will generally allow these bullets to pass through the solid material, which is a metallic material such as aluminum in one form but can include other materials such as polymers, steels, composites, and brass. Other methods of capturing bullets could be utilized such as threading a cone shaped cup into the front portion of the main body. The projectile redirection plate 161 in one form has an engagement surface 165 that is pointed forward and downward based in the longitudinally rearward to forward directions so as to impart any bullets impacting thereupon downwardly to prevent impacting anyone down-range from the firearm. The projectile receiving area 163 in one form has an approximate prescribed length indicated by the dimension 167 that is between 1 and 3 inches and has been made at 2" in width, given the strength of the material, such as aluminum 7075. Therefore, one reason that there is a distance of ½"-¾" in one form between the longitudinally trailing surface 149 and the longitudinally forward surface 151 is to provide a sufficiently short distance 167 of the projectile receiving area 163 so the bullets imparted therethrough will be sufficiently slow but will continue to the projectile redirection plate 161. In other words, if the projectile receiving area 163 is too long, the bullets passing therethrough may stack up or otherwise be redirected into lateral and upper locations, which are less desirable areas for the dispersion of bullets. In particular, if the firearm is on full auto mode, several bullets may pass down the muzzle and enter the blank firing adapter 120 before the operator of the firearm has realized his or her egregious mistake.

Figure 22:
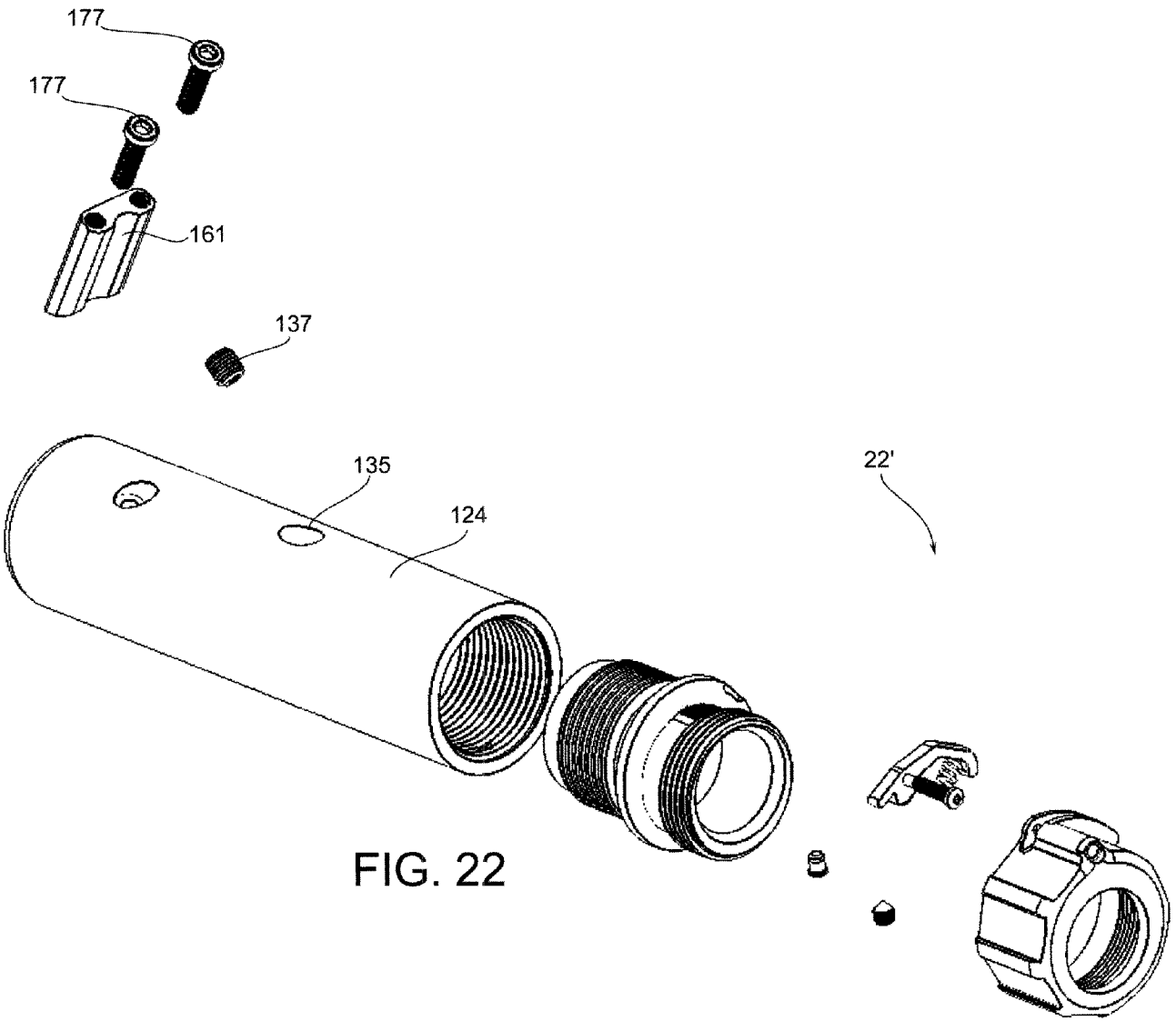
FIG. 22 shows an exploded view of the firearm blank adaptor.
Figure 23:
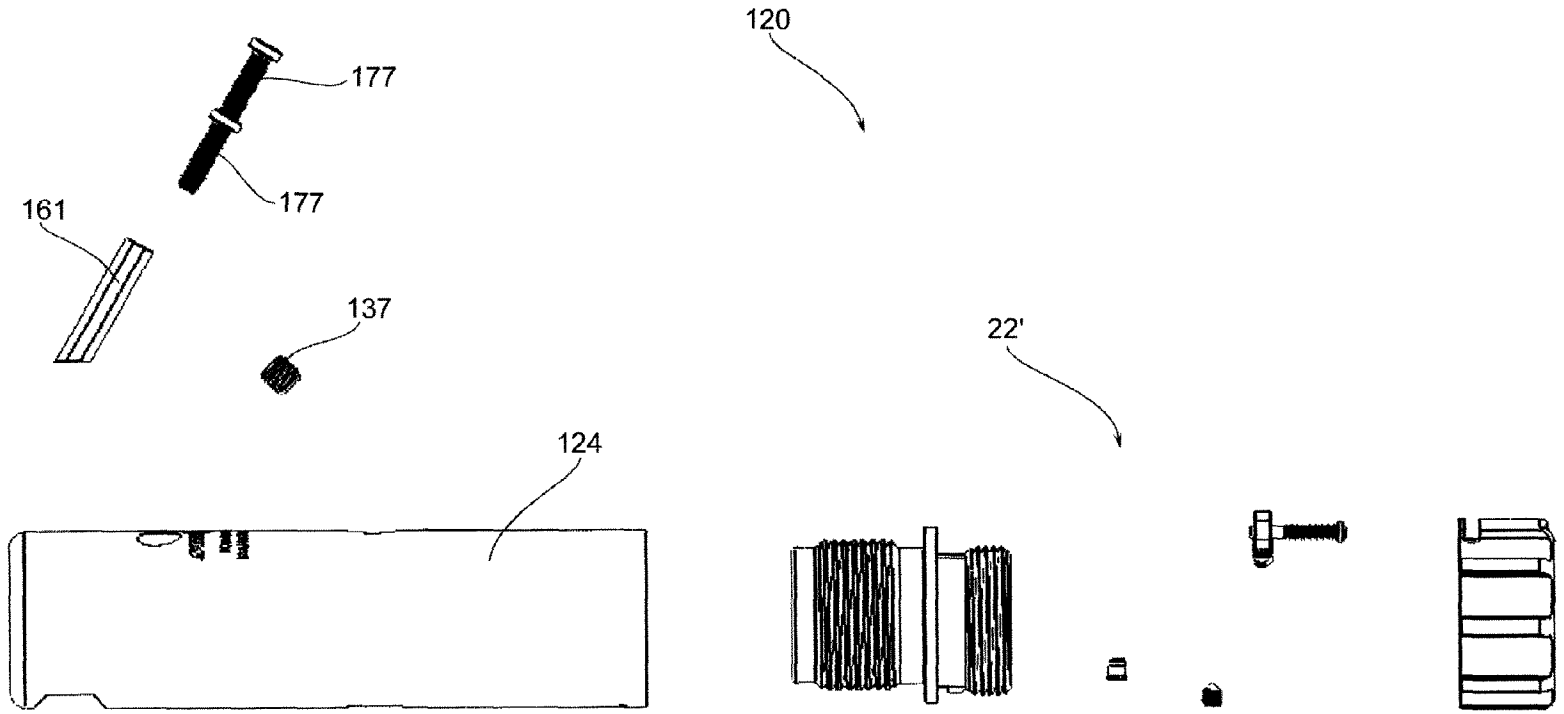
FIG. 23 shows a side profile view of the firearm blank adaptor.
Figure 24:
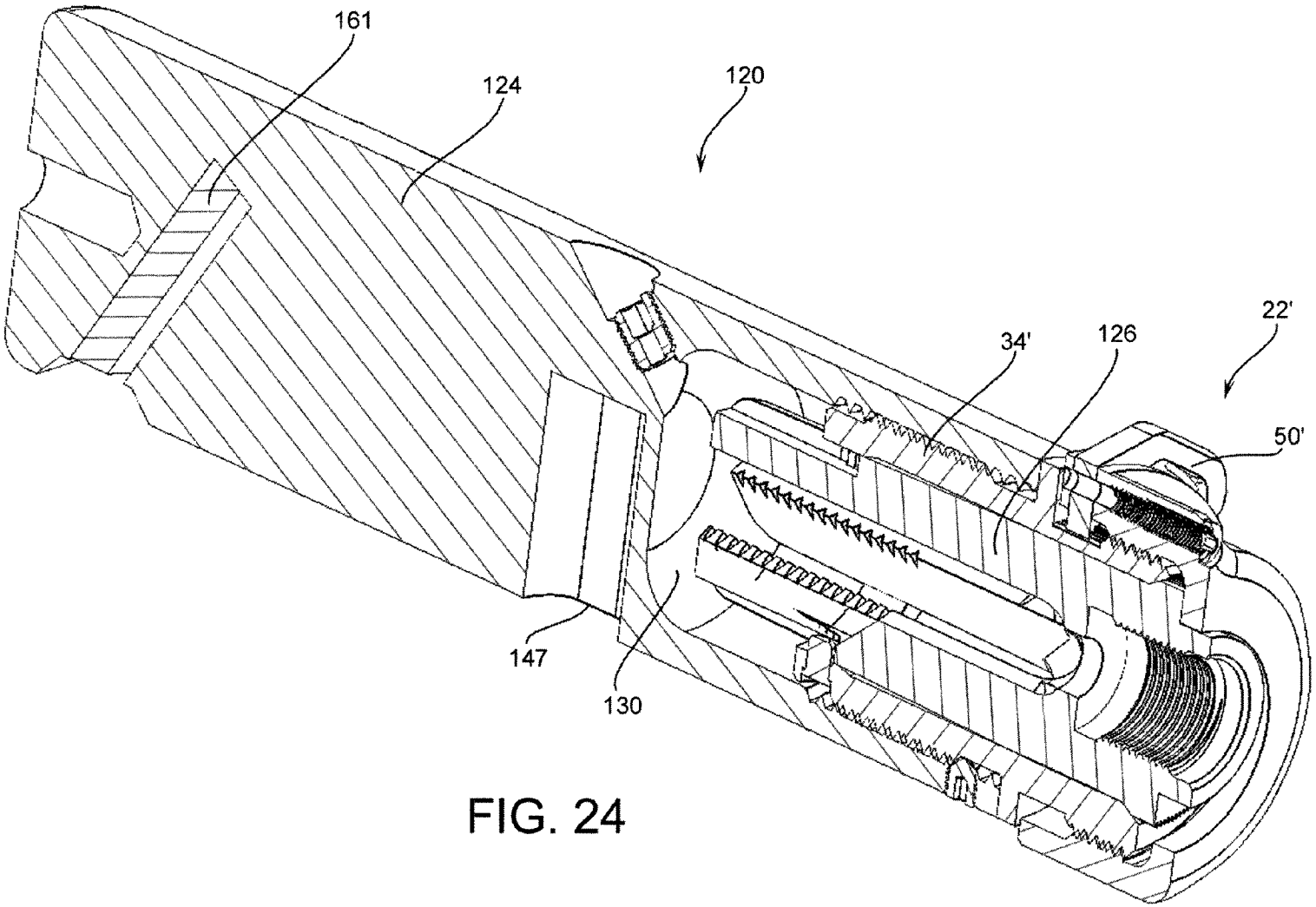
FIG. 24 shows an isometric cross-sectional view of a firearm blank adaptor showing a portion of the muzzle, such as a flash suppressor, positioned therein in a locked orientation.

As shown in FIG. 22, there is an exploded view where the main body 124 is shown and the bleed port 135 is provided where the bleed adjustment insert 137 is shown in an exploded form. The projectile redirection plate 161 in one preferred form is of a different harder metal than that of the main body 124. The projectile redirection plate 161 can be fastened in the upper portion by the fasteners 177 with a portion of the main body interposed between the annular heads thereof. Shown in the right-hand portion of FIG. 22 is one form of a locking assembly 22' which is similar in nature as described above. FIG. 23 shows a side view of the exploded blank firing adapter 120. FIG. 24 shows a cross-sectional view where, in this form, the blank firing adapter 120 shows a muzzle 126 inserted therein where one form of the muzzle is an attachment to the forward portion of the barrel where the barrel and the attachment generally form a muzzle region of the firearm. For purpose of explanation, the muzzle 126 which, in one form, is a suppressor is shown unthreaded but could, for example, be threaded to the threaded region 327 of a barrel as shown by example in FIG. 26.

Figure 25:
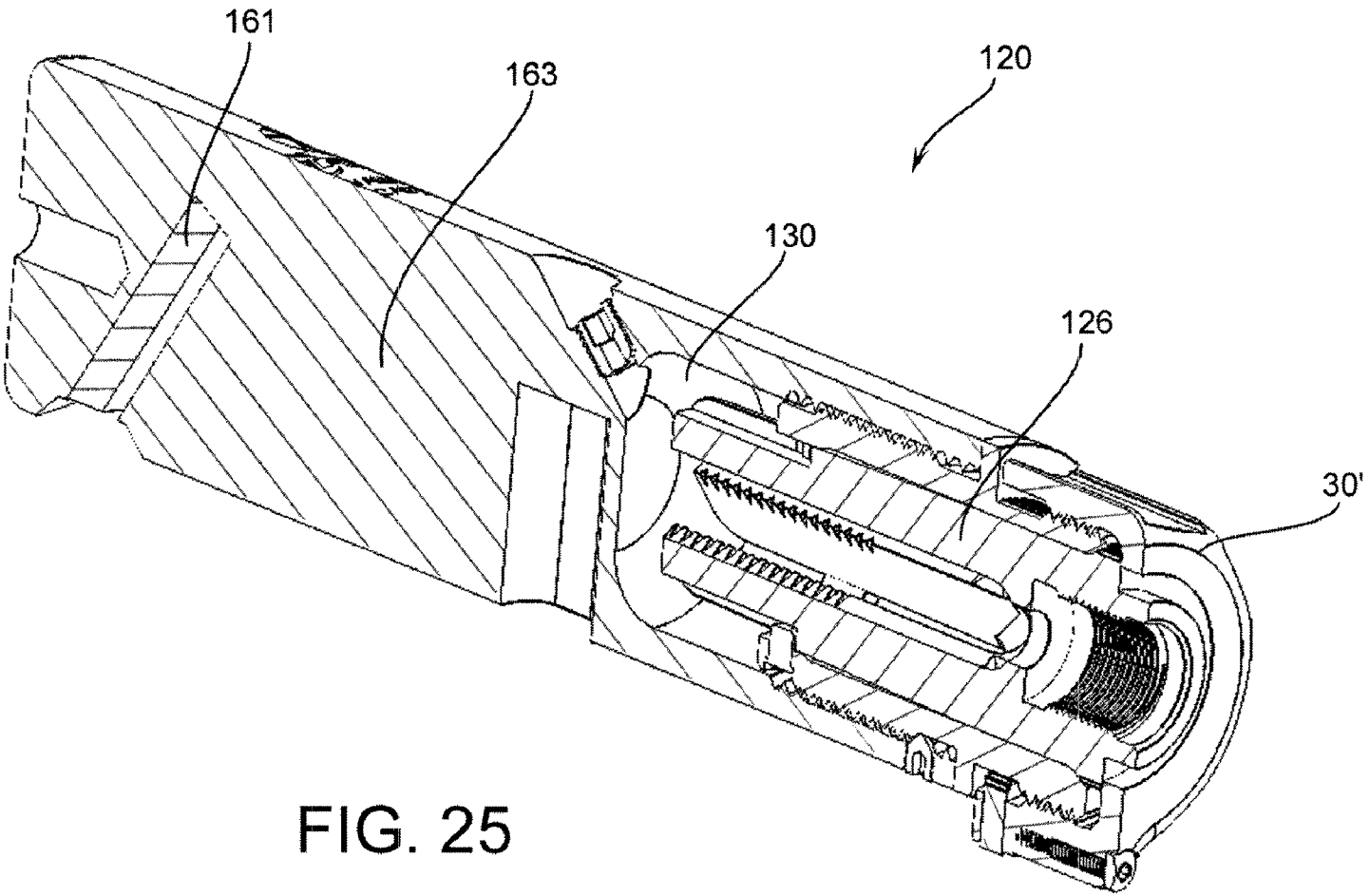
FIG. 25 shows the blank firing adapter with a portion of a muzzle positioned therein with the lock ring in an unlocked orientation.

It should be reiterated that the locking assembly 22' can be utilized with any type of attachment mechanism for the muzzle region of a firearm. In one form, this locking assembly 22' is shown with a blank firing adapter. FIG. 25 shows by way of example how the lock ring 30' is in an unlocked orientation whereby the muzzle of the firearm 126 (shown as a flash suppressor) can be withdrawn from the interior chamber 130.

Therefore, the embodiment as described above and generally shown in FIGS. 19-25 is operatively configured to have three rounds be held within the main body at the projectile receiving area 163, and all rounds passing therethrough thereafter will be redirected forwardly and downwardly by way of the projectile redirection plate 161. If the vector distance 167 as shown in FIG. 21 is too long, the rounds can take a more lateral and vertical path and not strike the projection redirection plate. In general, the blank firing adapter 120 can generally have a diameter between 1 and 3 inches in a broader range, where a preferred range is approximately 1.5 inches. Of course the relationship of the diameter to the length of the projectile receiving area 163 can be important for ensuring that the projectiles do not exit laterally but are rather redirected forwardly to be redirected by the projectile redirection plate 161.

Figure 26:
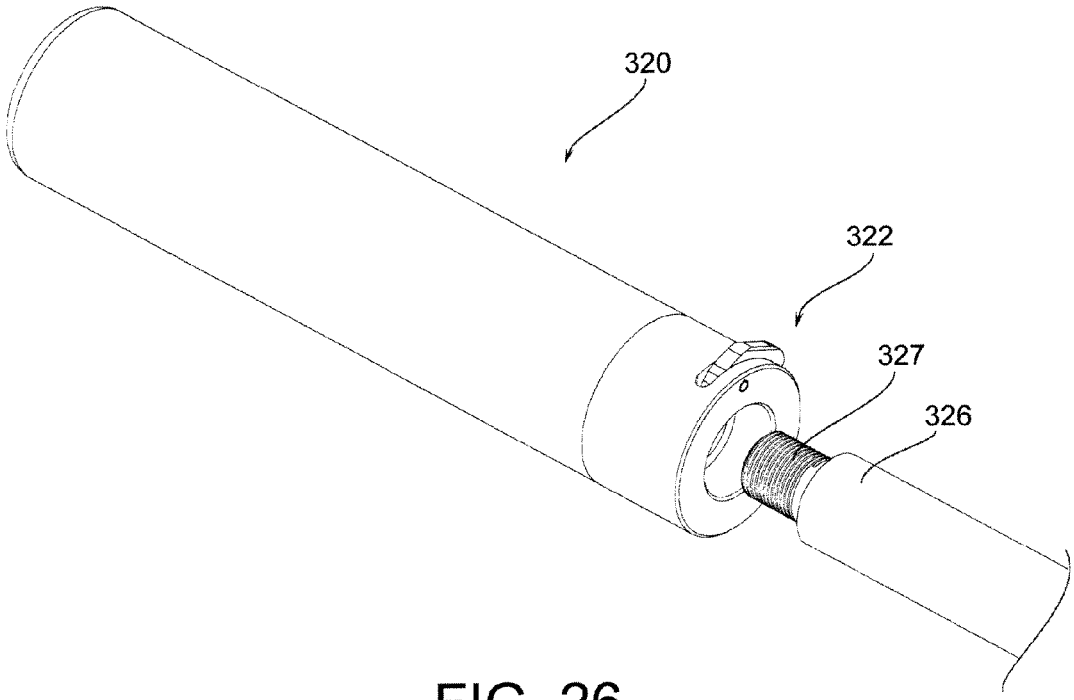
FIG. 26 shows another embodiment where a general firearm attachment is shown positioned adjacent to a muzzle which in one form has a threaded front portion.
Figure 27:
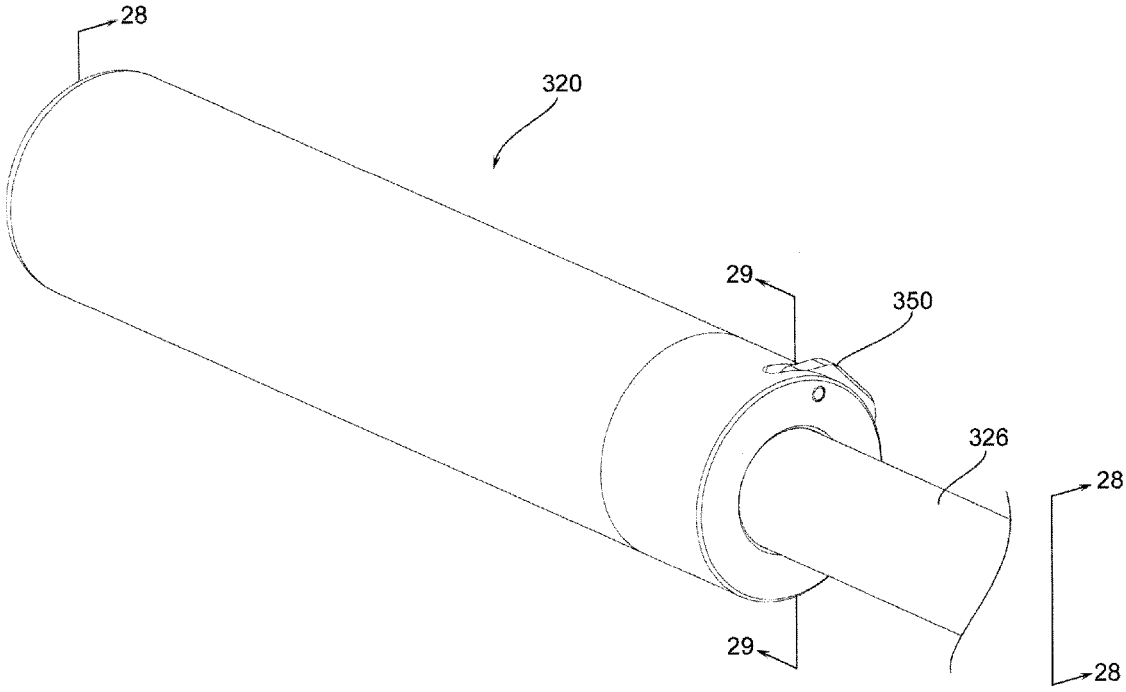
FIG. 27 shows the firearm attachment attached to the muzzle.
Figure 28:
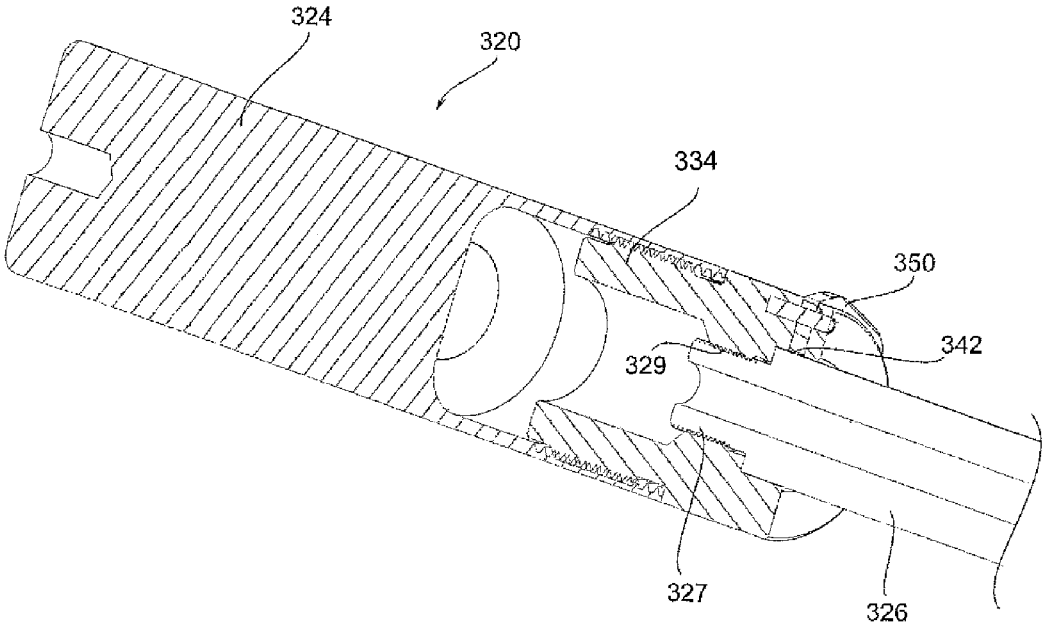
FIG. 28 shows the firearm attachment shown in cross-sectional view taken along line 28-28 of FIG. 27.

Now referring to FIG. 26 there is shown another embodiment of a locking assembly 322. In general, in this form, there is a muzzle 326 which is configured to fit within the suppressor or blank firing adapter, otherwise referred to as the firearm attachment 320. Now referring to FIG. 28 there is shown a cross-sectional view taken at line 28-28 of FIG. 27 which shows the firearm attachment 320 attached to the muzzle 326. It can be appreciated in FIG. 28 that the forward region 327 of the muzzle 326 is provided with a threaded region which in one form is a male threaded region operatively configured to be fitted to the firearm attachment 320 at the muzzle engagement region 329. Of course one traditional method of attaching a suppressor or other forms of firearm attachments is to threadedly engage such attachments to a threaded portion of the muzzle. In one form the firearm attachment 320 can be provided with a base mount 334 and a body 324, but there is a plurality of methods of arranging the components or providing a unitary structure for the firearm attachment 20. For purposes of discussion, FIG. 27 shows a hatched view of a variant of a blank firearms adapter, but could also be a suppressor, flash suppressor, or other type of attachment mechanism. It should be noted that the locking release lever 350 which is shown in partial sectional view now directly engages the muzzle and the muzzle provides the locking surface 342.

Figure 29:
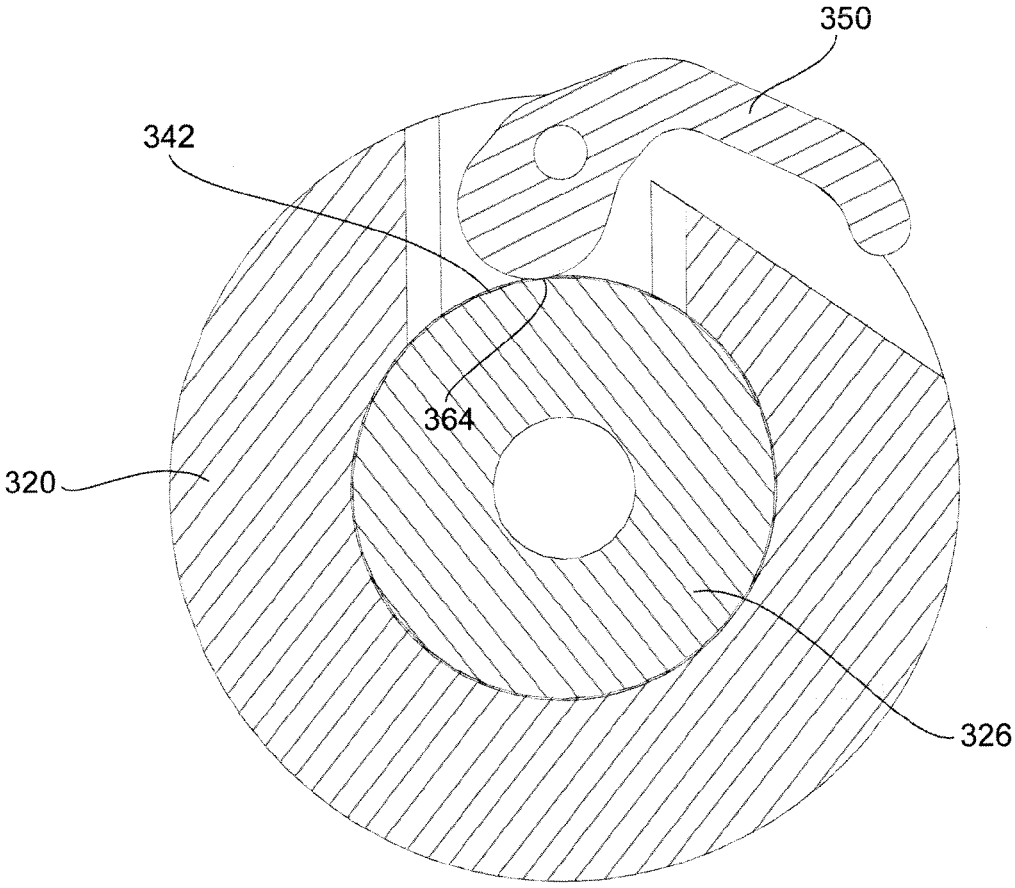
FIG. 29 shows a cross-sectional view taken from line 29-29 of FIG. 27.

Now referring to FIG. 29 there is shown a cross-sectional view taken at line 29-29 of FIG. 27 where the lock-and-release lever 350 can be shown to have a locking engagement surface 364 that directly engages the locking surface 342, which, in this case, is directly upon the muzzle 326. Of course, various other forms of the surfaces 364 and 342 can be provided, as described above in the various FIGS. 7A-7G as well as other possible arrangements as defined above.

Figure 30:
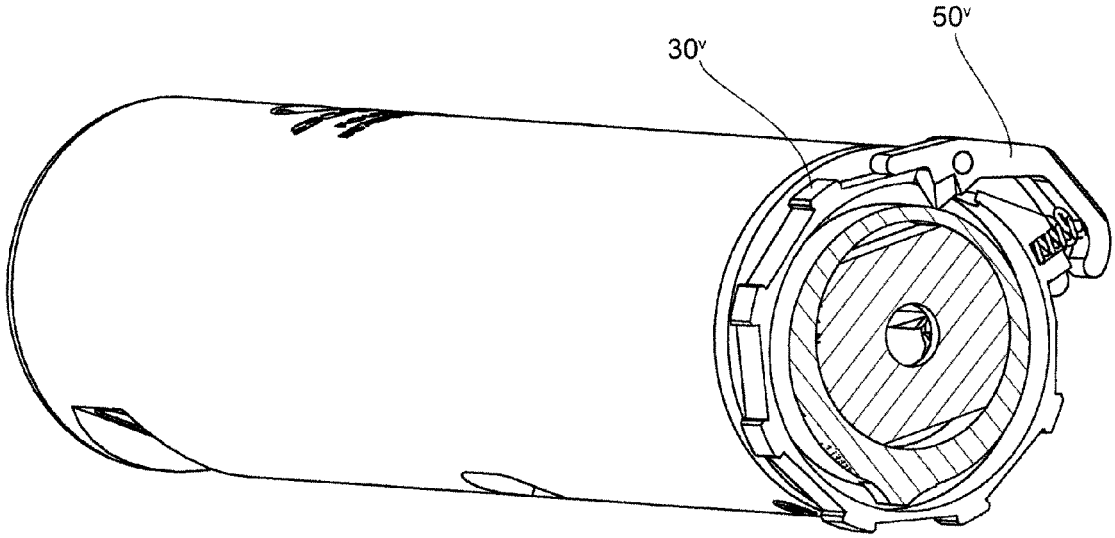
FIG. 30 shows another embodiment of a lock lever.
Figure 31:
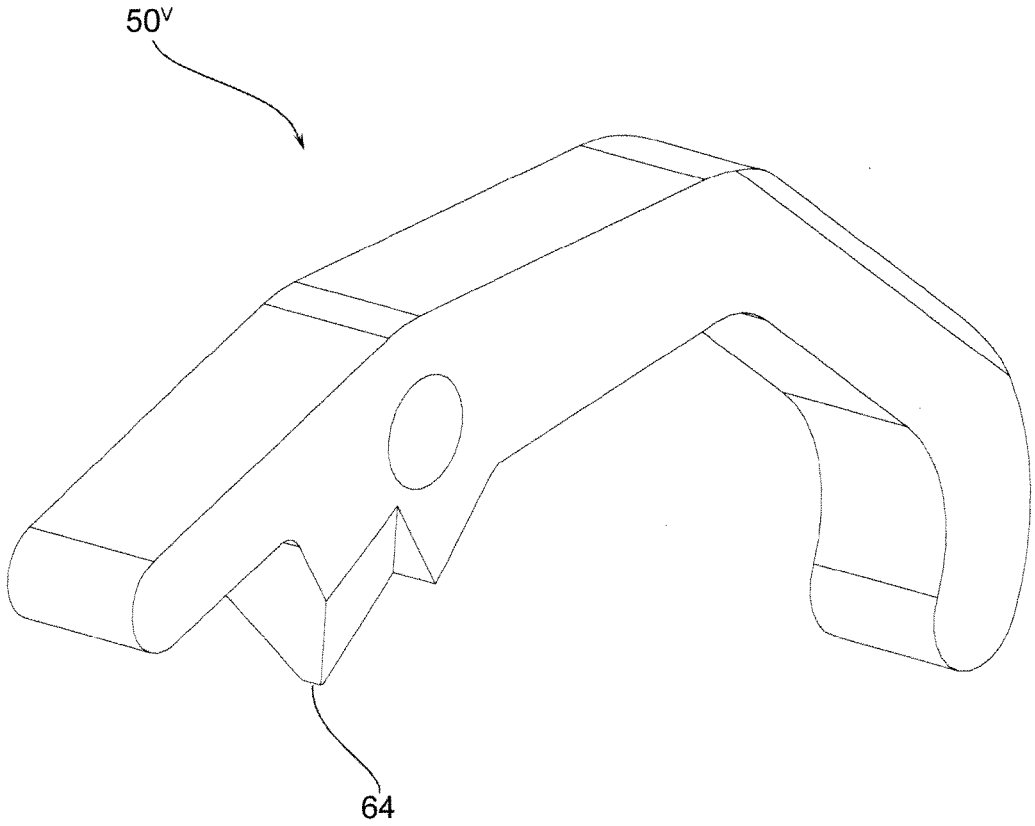
FIG. 31 shows an orthogonal view of the lock lever of FIG. 30 showing a smaller engagement region that tapers in the tangential and longitudinal directions.

Now referring to FIG. 30 there is shown yet another embodiment where the lock-and-release lever $\mathbf{50}^{V}$ is attached to the lock ring $\mathbf{30}^{V}$ in a similar manner as described above; however, as shown in FIG. 31, it can be seen that the lock-and-release lever $\mathbf{50}^{V}$ is arranged in such a manner that the lock engagement surface 64 is not only narrowed in the tangential direction but further in the longitudinal direction to find a point of contact. Basically, depending upon the hardness of the materials, a finer point can be utilized.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

We claim:

1. A firearm attachment configured to be attached to a muzzle of a firearm, the firearm attachment comprising:

a) a body comprising a lock ring attachment region;

b) a lock ring rotatably mounted to a mounting base of the body;

c) a lever pivotally attached to the lock ring, the lever comprising a lock engagement surface providing a base reference line formed in a convex arc having at least one arc center point that is offset with respect to a center of rotation of the lever; and d) a locking surface configured such that the lock engagement surface is in contact with the locking surface to prevent rotation of the lock ring.

2. The firearm attachment as recited in claim 1, wherein the lever comprises a release which provides rotation of the lever in a direction opposed to a force applied by a biasing member whereby engaging the release sufficiently disengages the lock engagement surface from the locking surface to allow the lock ring to rotate in an un-lock rotational direction.

3. The firearm attachment as recited in claim 2, wherein a force acting upon the lever at a force engagement region located at an area of engagement between the lock engagement surface and the locking surface is positioned at an opposite region of the center of rotation of the lever of a force applied to the lever by the biasing member.

4. The firearm attachment as recited in claim 1, wherein the biasing member acts as a first-class lever where the center of rotation of a pivot mount is a fulcrum point so the biasing member can apply a center of force upon the locking surface at a force engagement region of the lock engagement surface.

5. The firearm attachment as recited in claim 1, wherein the lock engagement surface comprises a plurality of teeth.

6. The firearm attachment as recited in claim 5, wherein the plurality of teeth are arranged so as to substantially conform along the base reference line.

7. The firearm attachment as recited in claim 1, wherein the base reference line of the lock engagement surface of the lever is non-circular, and an arc radius increases in a greater distance in a lagging locking rotational direction from the center of rotation of the lever.

8. The firearm attachment as recited in claim 1, wherein the center of rotation of the lever is at a constant position with respect to the lock ring.

9. The firearm attachment as recited in claim 1, wherein the firearm is a rifle.

10. The firearm attachment as recited in claim 1, wherein the mounting base is rigidly attached to a suppressor body to comprise a body.

11. The firearm attachment as recited in claim 10, wherein the mounting base is threadedly attached to the body.

12. The firearm attachment as recited in claim 11, wherein the locking surface is on the mounting base, and a lock ring attachment region is a male threaded portion, and the lock ring is a female threaded portion configured to be rotatably mounted to the male threaded portion of the base mount and is rotatable therewith.

13. The firearm attachment as recited in claim 1, wherein the locking surface is on the body.

14. The firearm attachment as recited in claim 1, wherein the locking surface is on the muzzle.

15. The firearm attachment as recited in claim 1, wherein the lock ring is rotatably mounted to the body having a prescribed amount of rotation.

16. The firearm attachment as recited in claim 15, wherein the prescribed amount of rotation of the lock ring with respect to the body is less than 270°.

17. The firearm attachment as recited in claim 1, wherein the locking surface is a gnarled surface upon the body.

18. The firearm attachment as recited in claim 1, wherein the locking surface is a substantially circular surface on the muzzle of the firearm around a central longitudinal axis of the muzzle.

19. The firearm attachment as recited in claim 18, wherein the locking surface comprises a plurality of teeth comprising a substantially circular array around the central longitudinal axis of the muzzle.

20. The firearm attachment as recited in claim 1, wherein the lock ring comprises one non-concentric engagement surface having an arc center that is non-concentric with the rotational center of the lock ring with respect to the body.

21. A firearm suppressor configured to attach to a muzzle of a firearm, comprising:

a) a suppressor body having a central longitudinal axis and an interior surface defining an interior chamber;

b) a lock ring rotatably mounted to the suppressor body, the lock ring comprising a convex lock engagement surface, the convex lock engagement surface being pivotally attached to the lock ring at a pivot mount having a center of rotation;

c) a locking surface attached to the suppressor body where the locking surface rotates with respect to the lock ring when the lock ring rotates from an unlocked configuration to the locked configuration, the convex lock engagement surface being configured to rotate in a lock configuration by engaging the locking surface to prevent rotation of the lock ring; and d) wherein a center of force acting between the locking surface and the convex lock engagement surface increases in magnitude as the lock engagement surface rotates further in a lock rotation.

22. The firearm suppressor as recited in claim 21, wherein the lock engagement surface has a center radius substantially concentric with the central longitudinal axis when in the unlocked configuration and the center radius of the lock engagement surface is non-concentric with the central longitudinal axis when the lock ring is in the locked configuration.

23. The firearm suppressor as recited in claim 22, wherein the lock ring is configured such that the unlocked configuration allows a muzzle to enter the interior chamber and thereby the lock ring is configured to rotate in a locking rotational direction whereby the non-concentric engagement surface engages the muzzle, thereby locking the suppressor to and the engagement between the lock engagement surface and the locking surface prevents rotation of the lock ring in an unlock rotational direction.

24. The firearm suppressor as recited in claim 21, wherein a release latch is provided and operatively configured to rotate the lock engagement surface in an unlock rotation, thereby disengaging the lock engagement surface from the locking surface.

25. The firearm suppressor as recited in claim 24, wherein the release latch operates as a first-class lever, thereby rotating the lock engagement surface away from the locking surface as a release lever is biased substantially radially inwardly towards the suppressor body.

26. The firearm suppressor as recited in claim 21, wherein the locking surface is substantially circular having a central longitudinal axis.

27. The firearm suppressor as recited in claim 21, wherein the suppressor body comprises a mounting base that is threadedly attached to a front tube and the mounting base provides the locking surface.

28. The firearm suppressor as recited in claim 21, wherein the locking engagement surface is a smooth surface.

29. The firearm suppressor as recited in claim 21, wherein the locking engagement surface comprises a plurality of teeth.

30. A locking system for a firearm attachment for attachment to a muzzle, the locking system comprising:

a) a lever pivotally attached to a firearm attachment at a pivot attachment location, the lever having a lock engagement surface that provides engagement with a locking surface, the lever and the pivot attachment location being rotatably mounted with respect to the muzzle of the firearm;

b) wherein the pivot attachment location, a center of rotation of the rotational path of the lever with respect to the muzzle, and a longitudinal axis define a reference plane in which an engagement between the lock engagement surface and the locking surface is located at a lateral portion of the reference plane in a lagging direction of rotation with respect to the lever when the lever is in forceful locking engagement between the lock engagement surface of the lever and the locking surface at a center of force location; and c) wherein a force vector is applied between the center of force location and the pivot attachment location, the force vector having a normal component and an orthogonal tangential component, wherein the ratio of force values between the normal component to the tangential component is at least 5:1 or greater.

31. The locking system as recited in claim 30, wherein the locking surface is on the firearm attachment.

32. The locking system as recited in claim 31, wherein the locking surface is provided on a body of the firearm attachment and the lever is pivotally attached to a lock ring that is rotatably mounted to the body.

33. The locking system as recited in claim 32, wherein the body of the firearm attachment comprises a suppressor body and a mounting base.

34. The locking system as recited in claim 33, wherein the mounting base is provided with a body attachment region that is operatively configured to be threadedly attached to the suppressor body and the mounting base further comprises a lock ring attachment region having a male threaded region having a center that is offset from threads on the body attachment region.

35. The locking system as recited in claim 30, wherein the locking surface is on the muzzle.

36. The locking system as recited in claim 35, wherein the lever is pivotally attached to the suppressor body which is operatively configured to be rotatably mounted to the muzzle by way of threaded engaging thereto where the lever engages an outer surface of the muzzle.

37. A locking assembly for a firearm attachment configured to rigidly mount the firearm attachment to a muzzle of a firearm, the locking assembly comprising:

a) a lock extension providing a locking engagement surface, the lock extension being pivotally attached to the firearm attachment at a pivot attachment location; and b) a locking surface operatively configured to engage the lock engagement surface of the lock extension where the lock extension is biased towards the locking surface, the engagement between the locking engagement surface and the locking surface defining a force engagement region having a center of force therebetween, wherein lock rotation of the lock extension increases the distance of the center of force to the pivot attachment location of the lock extension per degree of rotation about the pivot attachment location, and no more than about 7% of the distance per every ten degrees of rotation.

38. The locking system as recited in claim 37, wherein the lock extension is a part of a lever that is pivotally attached to a lock ring that is rotatably mounted to the firearm attachment.

39. The locking system as recited in claim 38, wherein a biasing member biases the lever so the lock engagement surface is in forceful contact with the locking surface.

40. The locking system as recited in claim 39, wherein the locking surface is positioned on the firearm attachment.

41. The locking system as recited in claim 37, wherein the locking surface is positioned on the muzzle of the firearm.

* * * * *